US008926227B2

(12) United States Patent
Zago et al.

(10) Patent No.: US 8,926,227 B2
(45) Date of Patent: Jan. 6, 2015

(54) METHOD AND SYSTEM FOR RAISING A BUILDING STRUCTURE

(75) Inventors: Roberto Zago, Rovereto (IT); Lamberto Zambianchi, Villafranca (IT); Gioacchino Marabello, Padua (IT); Stefano Scuttari, Saonara (IT)

(73) Assignees: SO.L.E.S.—Societa' Lavori Edili E Serbatoi S.p.A., Forli' (IT); Mattioli S.p.A., Padua (IT)

( * ) Notice: Subject to any disclaimer, the term of this patent is extended or adjusted under 35 U.S.C. 154(b) by 1140 days.

(21) Appl. No.: 12/735,296

(22) PCT Filed: Dec. 30, 2008

(86) PCT No.: PCT/IB2008/003653
§ 371 (c)(1), (2), (4) Date: Oct. 19, 2011

(87) PCT Pub. No.: WO2009/087469
PCT Pub. Date: Jul. 16, 2009

(65) Prior Publication Data

US 2012/0114423 A1 May 10, 2012

(30) Foreign Application Priority Data

Dec. 31, 2007 (IT) ..... B02007A0857
Sep. 3, 2008 (IT) ..... B02008A0537

(51) Int. Cl.
*E02D 35/00* (2006.01)

(52) U.S. Cl.
CPC ..... *E02D 35/00* (2013.01)
USPC ..... 405/230; 405/229; 405/231

(58) Field of Classification Search
USPC ..... 405/229, 230, 231, 232; 52/64, 126.1, 52/126.5, 741.1, 741.11
See application file for complete search history.

(56) References Cited

U.S. PATENT DOCUMENTS 6,923,599 B2 * 8/2005 Kelso ..... 405/230

FOREIGN PATENT DOCUMENTS

WO WO 2006/016277 2/2006
WO WO 2007/138427 12/2007

OTHER PUBLICATIONS

Declaration of Non-Establishment of International Search Report and Written Opinion in PCT Appln. No. PCT/IB2008/003653, mailed Jan. 7, 2009.
International Preliminary Report on Patentability in PCT Appln. No. PCT/IB2008/003653, dated Jul. 6, 2010 [6 pages].

* cited by examiner

*Primary Examiner* — Sean Andrish
(74) *Attorney, Agent, or Firm* — Davidson Berquist Jackson & Gowdey, LLP

(57) ABSTRACT

A method of raising a building structure (1) with respect to the ground (2); the method including the steps of: forming a mat (7) having a number of through holes (12), each surrounded by a number of upward-projecting ties (16); inserting a foundation pile (9) through each hole (12); attaching to each foundation pile (9) a lifting device (11), which on one side rests on the top end of the foundation pile (9), and on the other side is secured to the corresponding ties (16) which act as reaction members; exerting thrust on the foundation piles (9) by means of the lifting devices (11) to lift the building structure (1) with respect to the ground (2); dividing lift of the building structure (1) into a succession of lift steps; establishing a predetermined lift value for each lift step; and, at each lift step, operating each lifting device (11) to expand the lifting device (11) by exactly the predetermined lift step value.

21 Claims, 20 Drawing Sheets

METHOD AND SYSTEM FOR RAISING A BUILDING STRUCTURE

TECHNICAL FIELD

The present invention relates to a method and system for raising a building structure.

BACKGROUND ART

In the building industry, it is often necessary to raise a building structure, e.g. to raise a riverside or seafront, building above flood or high-tide level. A typical example of this is the city of Venice, where the ground floors of buildings are regularly flooded by so-called "high-water phenomena".

Alternatively, a building may be raised to build a basement underneath, in situations in which excavating underneath the building is undesirable or impossible, or to increase the height, to make full use, of a floor.

Patent IT1303956B proposes a method of raising a building structure, whereby a new foundation for the building structure is constructed with a number of through holes and, for each through hole, a connecting member projecting at least partly upwards and fixed to the foundation, next to the hole; next, a pile is inserted through each hole, and a first thrust is exerted statically on the pile to drive it into the ground (the first thrust is applied by a thrust device located over and cooperating with a top end of the pile, and connected to the projecting part of the connecting member, which acts as a reaction member for the thrust device when driving in the pile). Once all the piles are driven into the ground, a second thrust is applied statically between each pile and the foundation to raise the building structure with respect to ground; and, after the lift, each pile is fixed axially to the foundation.

Patent Application WO2006016277A1 proposes a method of raising a building structure resting on a supporting body in turn resting on the ground, whereby a new foundation of the building structure is constructed with a number of through holes and a number of connecting members, each fixed to the foundation close to a hole; next, a pile is inserted through each hole, so that the bottom end of the pile rests on the supporting body, and the top end projects from the hole. At this point, each pile is attached to a thrust device resting on the top end of the pile on one side, and connected to the corresponding connecting member on the other side; and thrust is applied statically to the piles by means of the thrust devices to raise the building structure with respect to the supporting body. Once the lift is completed, each pile is fixed axially to the foundation. The main difference between the methods described in Patent IT1303956B and Patent Application WO2006016277A1 lies in Patent IT1303956B driving each pile into the ground individually before commencing the lift, whereas, in Patent Application WO2006016277A1, given the existing supporting body between the building structure and the ground, lifting is performed without driving the piles into the ground first.

In the case of building structures of considerable size and/or particular structural situations, the above known lifting methods leave room for improvement. That is, during the lift, the structure may be subjected to severe stress requiring major consolidation work.

To reduce stress on the building structure during the lift, Patent Application WO2007138427A2 proposes dividing the lifting devices into three equal, symmetrical, independent work groups. During the lift, the lifting devices of only one work group at a time are operated simultaneously, while those of the other two groups are left idle, so the building structure is raised isostatically.

For the lift method in Patent Application WO2007138427A2 to work properly, the three work groups must be as equal as possible, i.e. comprise roughly the same number of lifting devices and be as symmetrical as possible, i.e. the thrust barycentres of the three work groups must correspond as closely as possible to the vertices of a preferably equilateral triangle with its centre at the barycentre of the weight of the building structure and the mat to be lifted. For the lift method in Patent Application WO2007138427A2 to work properly, the barycentre of the weight of the building structure to be lifted must therefore be determined accurately.

In certain situations, however, it is not easy to accurately determine the barycentre of the weight of the building structure (especially in the case of historic buildings, in which the actual consistency and hence weight of the walls is difficult to assess) or to divide the lifting devices into three equal, symmetrical groups (especially in the case of buildings with an irregular plan). In some situations, therefore, the lift method in Patent Application WO2007138427A2 proves difficult to implement.

In the patent applications referred to above, each through hole in the new mat is lined with a metal guide tube having an annular anchoring flange to which the stays are fixed. When driving in the foundation pile, the shaft of the foundation pile slides axially with respect to the guide tube integral with the mat, and likewise when raising the building structure. It has been observed, however, that whereas, when driving in the foundation pile, the shaft of the foundation pile slides freely with no problems along the guide tube, even severe sliding friction may occur between the shaft of the foundation pile and the guide tube when raising the building structure.

This sliding friction is particularly harmful by producing random, unpredictable, localized irregularities in the lifting process, in turn resulting in even severe stress within the mat. It may even result in damage (i.e. uncontrollable deformation) of the foundation pile shaft, thus impairing performance of the pile. The main reason for this sliding friction between the foundation pile and the guide tube is that, when driving in the pile, plastic concrete is pressure-injected beneath the mat to fill the tubular channel formed by the wider foot of the pile as it sinks into the ground, and may leak into the gap between the foundation pile shaft and the guide tube. When driving in the pile, the concrete is still fresh, i.e. highly liquid, and so produces no significant friction as the shaft slides along the guide tube. On the other hand, during the lift (which normally takes place at least a month after the piles are driven), the concrete between the shaft and the guide tube has set and may produce even severe friction as the shaft slides along the guide tube.

DISCLOSURE OF THE INVENTION

It is an object of the present invention to provide a method and system for raising a building structure, which are cheap and easy to implement and provide for eliminating the aforementioned drawbacks.

According to the present invention, there are provided a method and system for raising a building structure, as claimed in the accompanying Claims.

BRIEF DESCRIPTION OF THE DRAWINGS

A number of non-limiting embodiments of the present invention will be described by way of example with reference to the accompanying drawings, in which:

FIG. 5A shows a larger-scale lateral section of the initial configuration of a foundation pile connected to a pile-driving device before being driven into the ground and FIG. 5B shows an enlarged view of a portion of FIG. 10A;

PREFERRED EMBODIMENTS OF THE INVENTION

Figure 1:
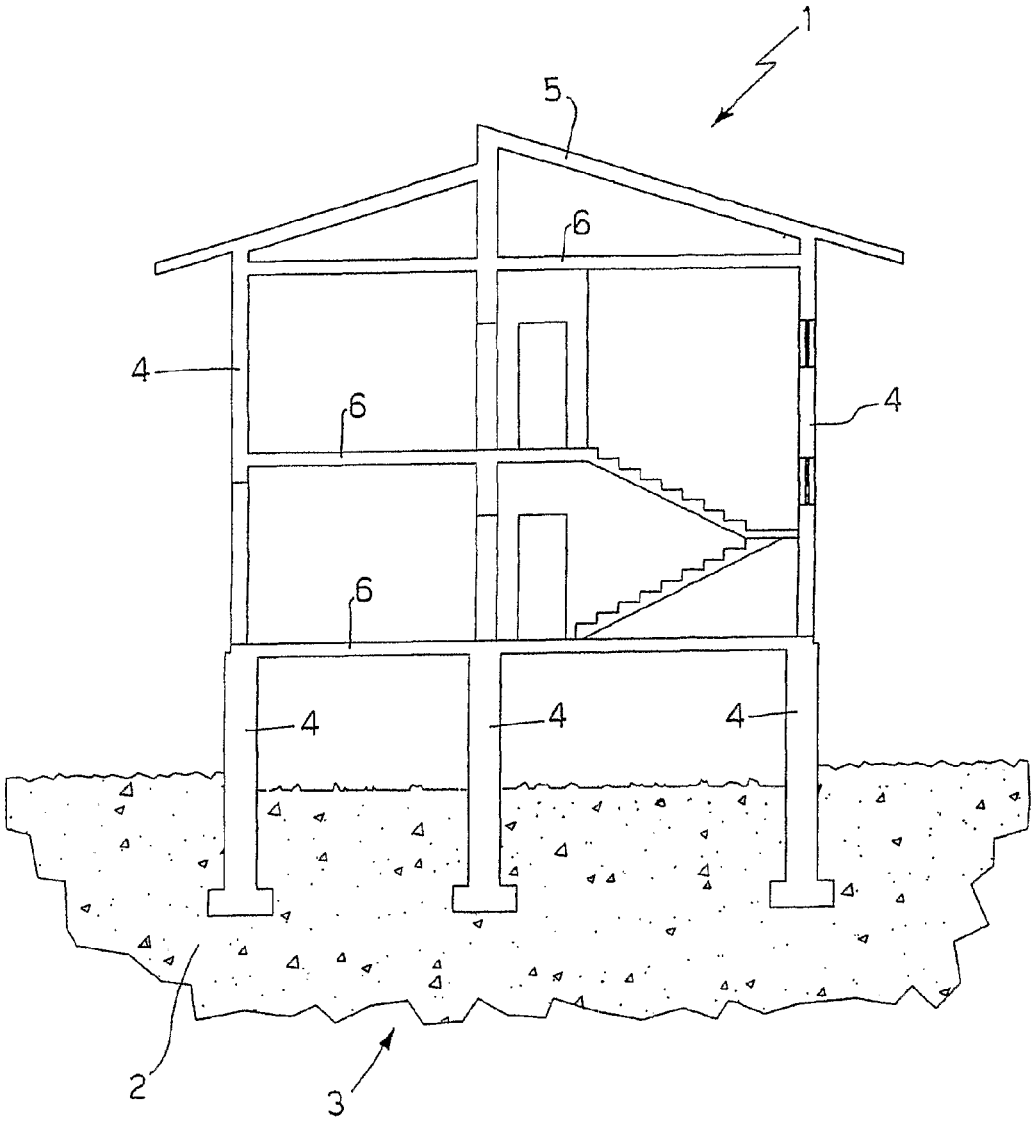
FIGS. 1, 2, 4, 9 and 15 show schematic sections of a building raised using the method according to the present invention.

Number 1 in FIG. 1 indicates as a whole a building resting on the ground 2 on a foundation structure 3, and to be raised with respect to ground 2. Building 1 comprises a number of supporting walls 4, each of which rests on foundation structure 3, extends up to a roof 5, and supports three floors 6. Building 1 also comprises a number of non-supporting walls not shown in the drawings.

To begin with, a survey is made of building 1 to determine the distribution of the masses it is composed of. This consists of a graphic representation of the plan at various levels, and of all the masonry structures, including door and window openings and any damage to the masonry. Given the thickness and density of the masonry structures, it is possible to determine their weight and distribution.

Building 1 is also analysed statically to make sure it can withstand minor stress induced by the lift, and may be consolidated and reinforced, if necessary, before the actual lift.

The ground 2 under building 1 is then examined to determine exactly what can be expected down to a depth of at least 5 m below level zero. Knowing the nature of ground 2 under building 1 is necessary to choose the type of foundation to construct (e.g. long piles, short piles or even footings).

Figure 2:
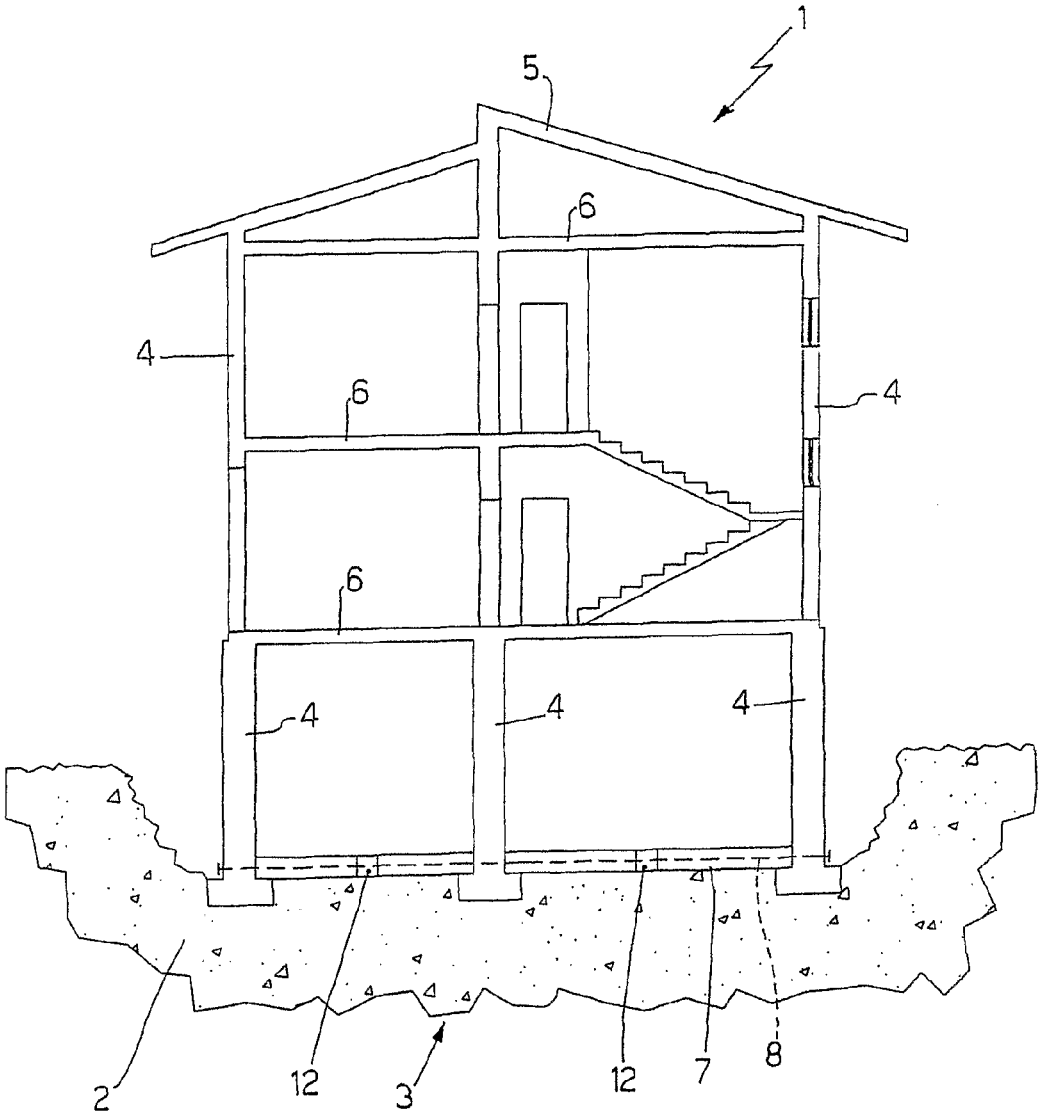
Figure 3:
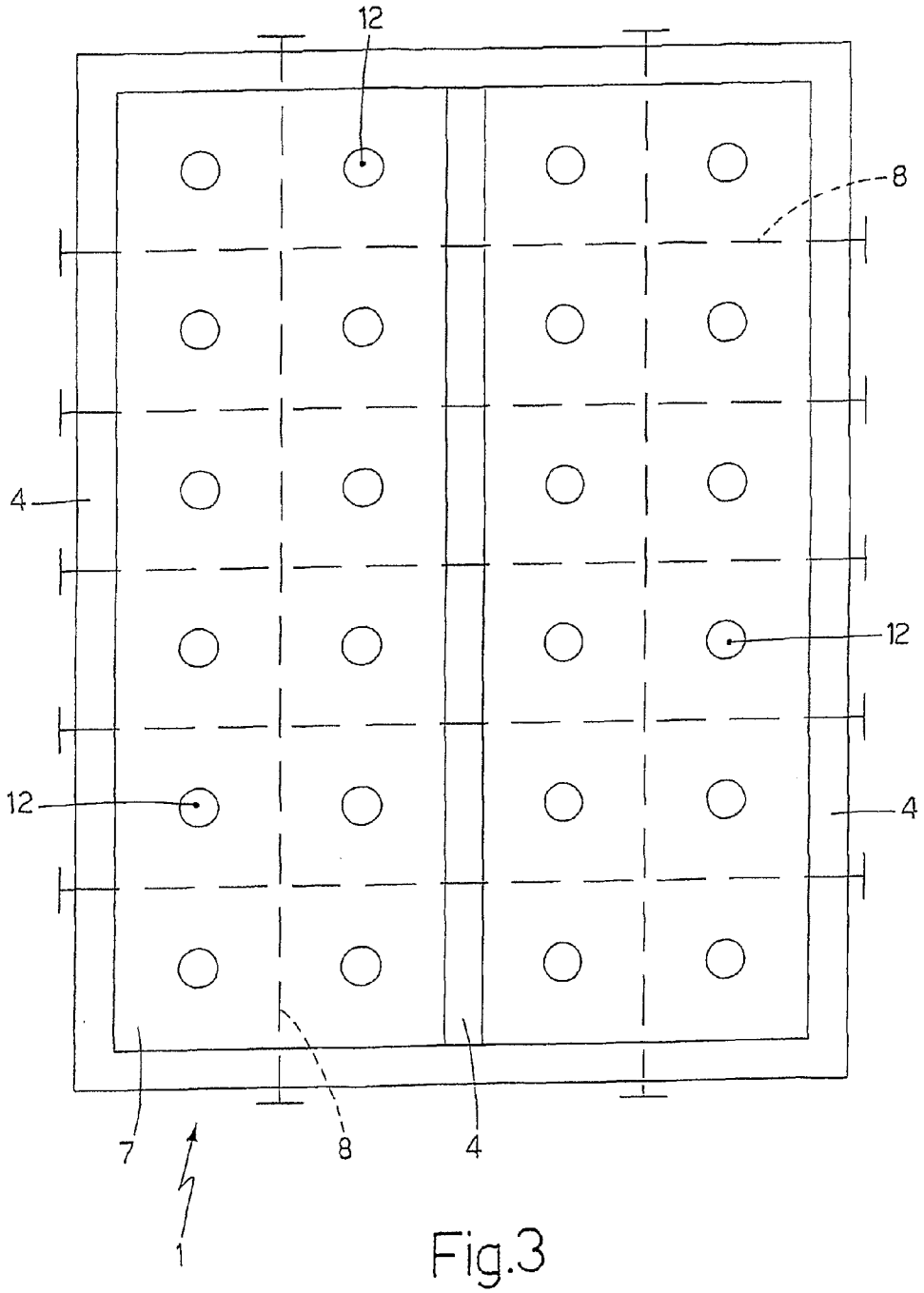
FIGS. 3 and 12 show schematic plan views of a new foundation structure of the FIG. 1 building.

As shown in FIGS. 2 and 3, a reinforcing mat 7 (or, more generally speaking, another type of foundation structure) is first constructed, and which forms part of a new foundation structure of building 1, extends over at least the whole base of building 1, and is made of post-tensioned reinforced concrete. In a different embodiment not shown, reinforcing mat 7 is made of normal (i.e. non-prestressed) reinforced concrete. To construct mat 7, ground 2 is normally excavated to a depth at least equal to the thickness of mat 7; and mat 7 is designed rigid and strong enough to absorb the stress produced by eccentricity of the bottom reactions and the distribution of the loads transmitted by supporting walls 4.

Mat 7 is typically constructed in portions extending between the walls. To achieve structural continuity between the various portions of mat 7 and supporting walls 4, mat 7 is post-tensioned by means of a number of metal post-tensioning cables 8 (shown by dash lines in FIGS. 2 and 3), each of which is embedded in mat 7 and inserted through respective through holes (not shown) in supporting walls 4. By virtue of post-tensioning cables 8, the various portions of mat 7 tighten supporting walls 4 to one another to achieve substantial structural continuity, so that flexural and shear continuity are established by the supporting walls 4 themselves interposed between adjacent portions of mat 7. In a different embodiment not shown, post-tensioning cables 8 are replaced by similar high-tensile steel bars or sections.

If supporting walls 4 are not very coherent, cohesion may be improved by resin injection or bolting.

Figure 4:
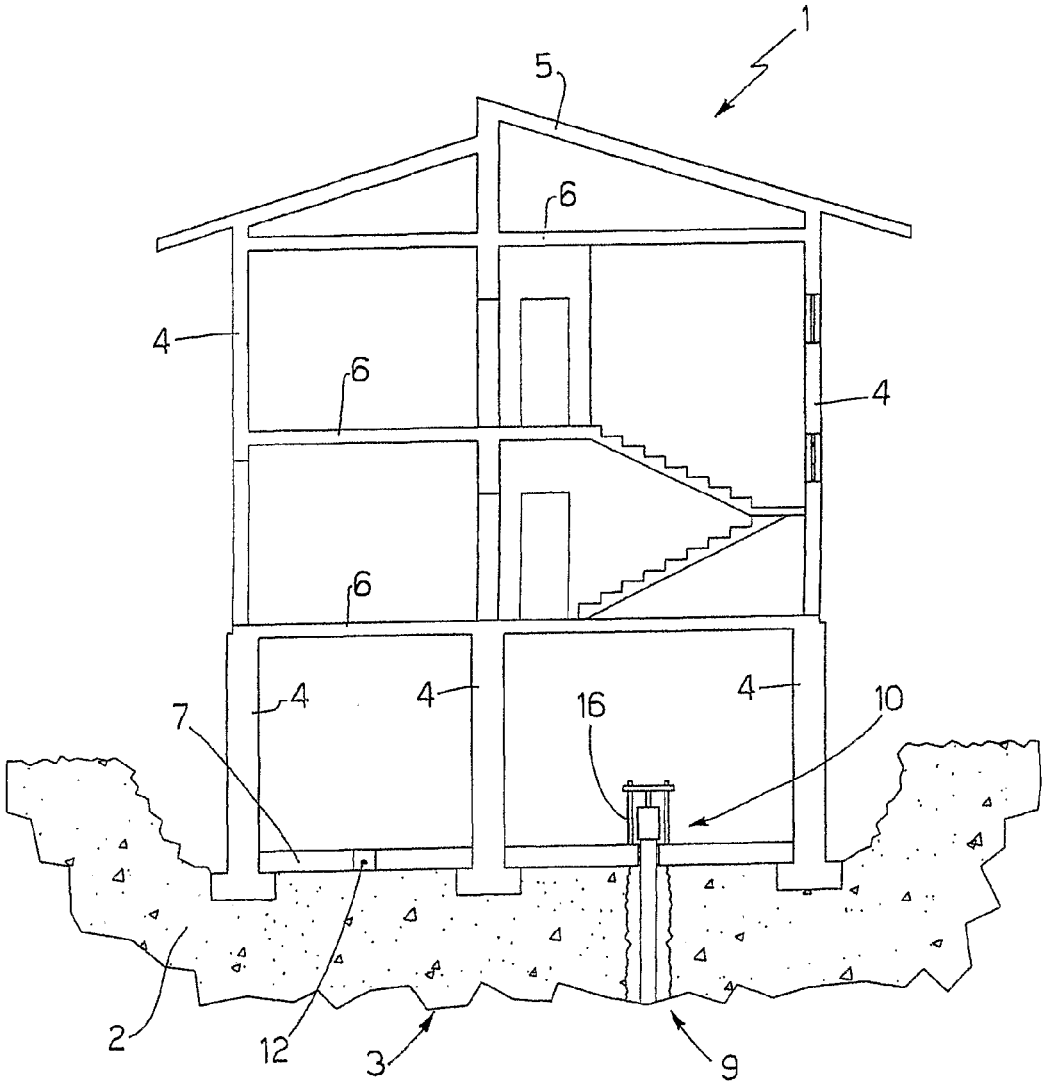
Figure 5A:
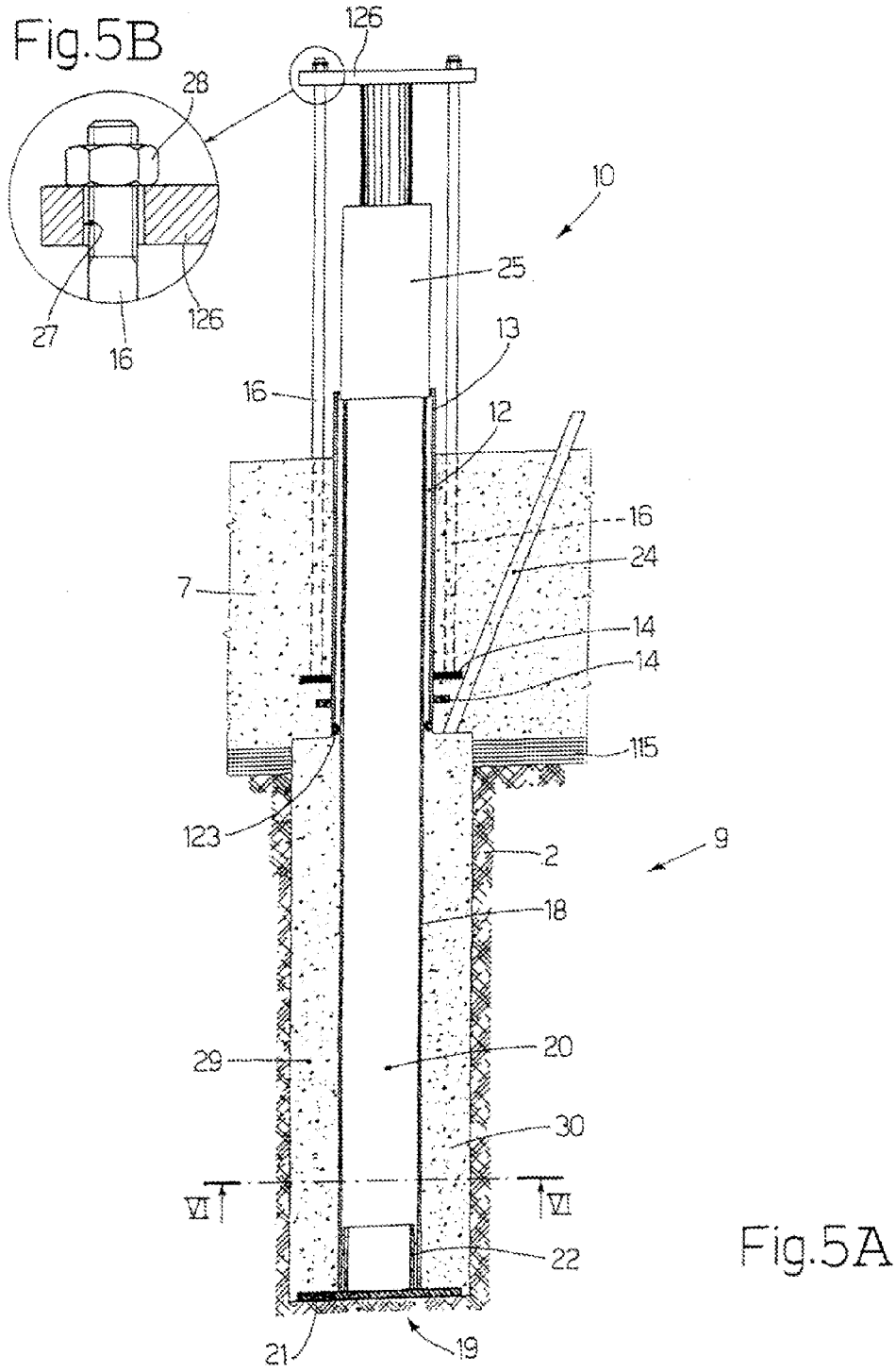
Figure 6:
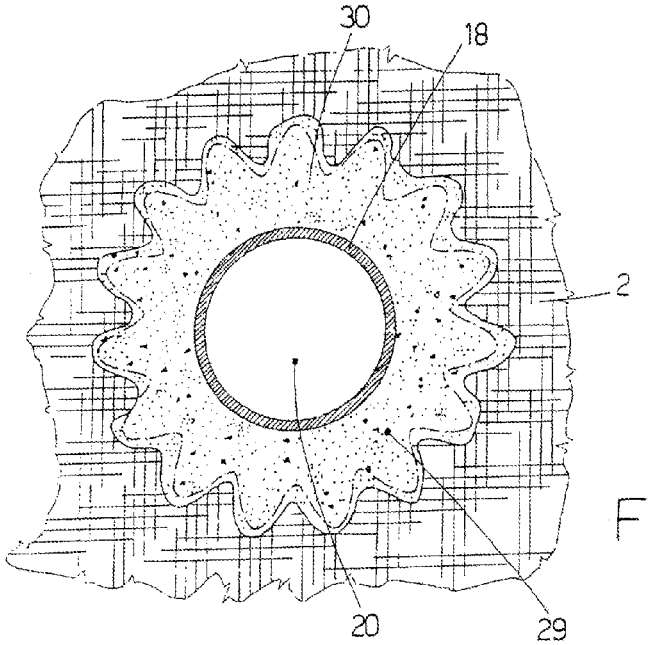
FIG. 6 shows a section along line VI-VI of the FIG. 5 foundation pile.
Figure 9:
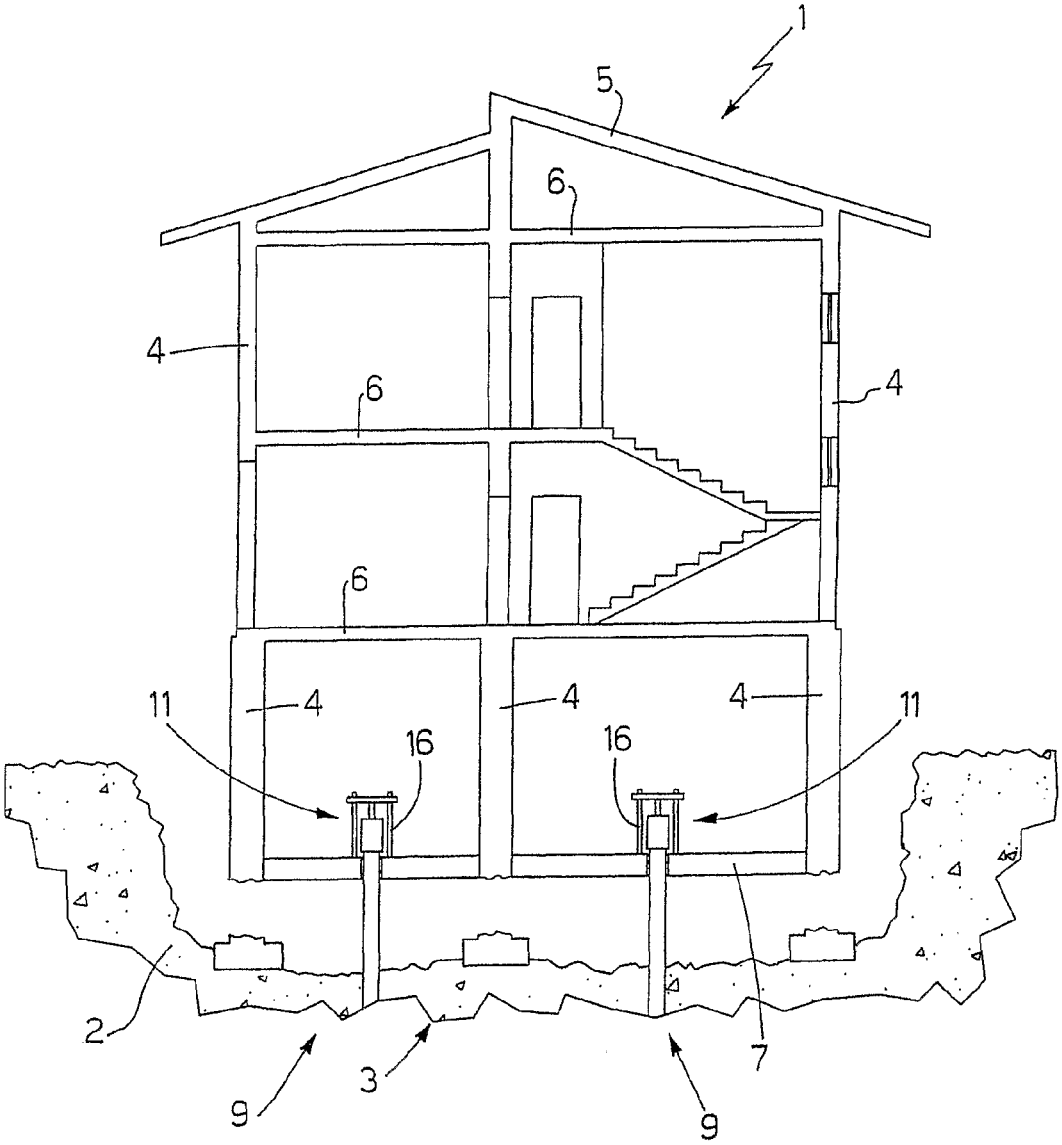

When constructing mat 7, some areas of mat 7 are prepared for driving in foundation piles 9 (shown for example in FIGS. 4 and 5A), for anchoring pile-driving devices 10 (one of which is shown in FIG. 5A), and for anchoring lifting devices 11 (one of which is shown in FIG. 9). Foundation piles 9 are distributed over the area of building 1 to balance as best as possible the weight of building 1 and mat 7.

Figure 7:
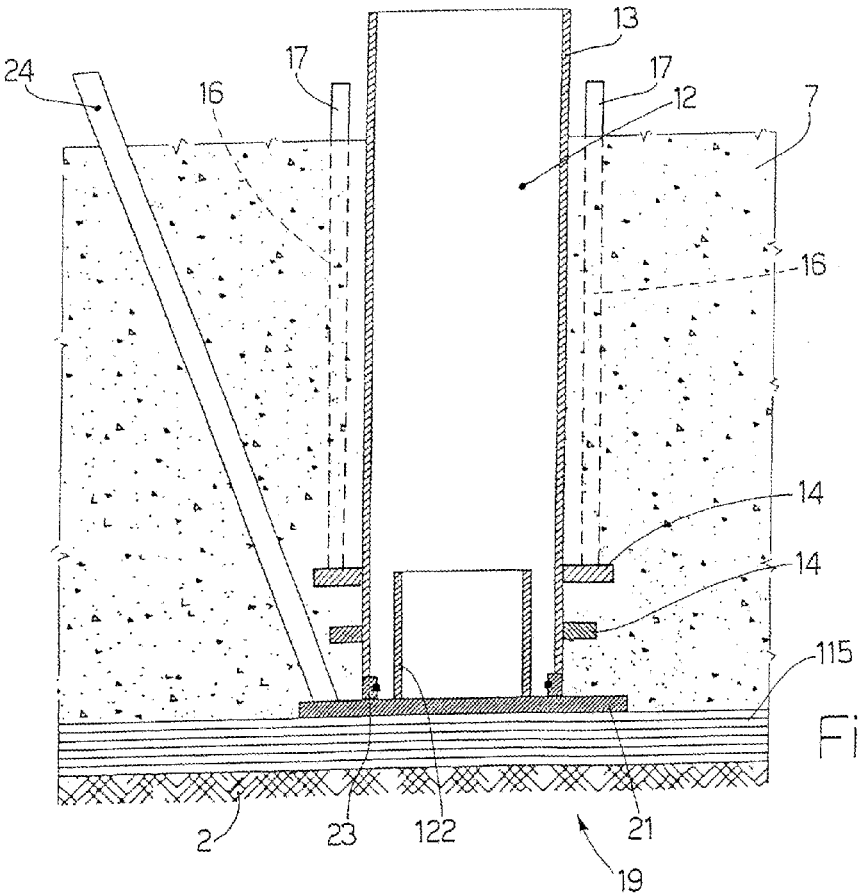
FIG. 7 shows a larger-scale lateral section of the initial configuration of the FIG. 5 foundation pile before being driven into the ground.
Figure 8:
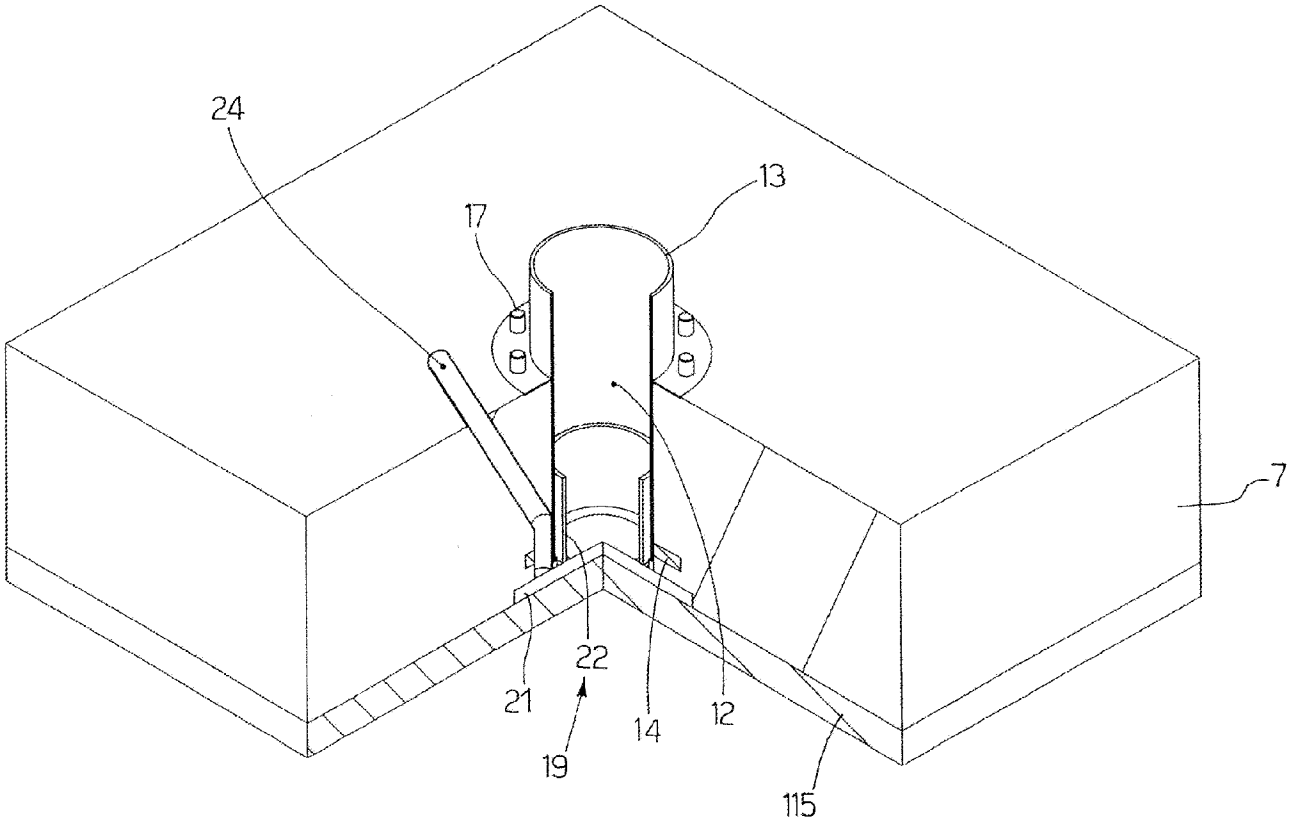
FIG. 8 shows a schematic view in perspective, with parts removed for clarity, of the FIG. 5 foundation pile before being driven into the ground.

As shown in FIGS. 7 and 8, for each foundation pile 9, mat 7 comprises a vertical hole 12 (of cylindrical or other section) lined with a metal guide tube 13, which is fixed to mat 7 by at least one metal fastening ring 14 embedded in mat 7, and has a top portion projecting upwards from mat 7. A layer 115 of relatively so-called lean concrete is preferably interposed between mat 7 and ground 2. Fastening ring 14 is normally located close to ground 2, i.e. at the bottom of mat 7. One fastening ring 14 is normally enough, though a number of fastening rings 14 may be provided at different levels.

Each hole 12 is surrounded with a number of threaded anchoring ties 16, each of which is connected to fastening ring 14, extends through mat 7, and projects vertically outwards of mat 7. A connector 17 (FIGS. 8 and 11) is screwed to the top portion of each anchoring tie 16 projecting outwards of mat 7, and may be screwed, on the opposite side, with an extension of anchoring tie 16. Anchoring ties 16 are equally spaced about hole 12, and normally number from 6 to 12 for each hole 12. It should be pointed out, however, that, in certain situations, two anchoring ties 16 for each hole 12 may be sufficient.

As shown in FIG. 5A, each foundation pile 9 is a metal pile, and comprises a substantially constant-section shaft 18 normally defined by a number of tubular segments of equal length joined end to end (normally by a cold-force-fitted connecting sleeve or welded with a connecting sleeve in between); and a wide bottom foot 19 defining the bottom end of foundation pile 9. Shaft 18 may obviously be other than circular in section, and may be solid, e.g. may be defined by an I-beam.

Each shaft 18 is tubular, has a through inner conduit 20, and is smaller crosswise than relative hole 12 to fit relatively easily through hole 12. Each foot 19 is defined by a flat, substantially circular plate 21 with a jagged outer edge, but may obviously be defined by a flat plate 21 of a different shape, e.g. oval, square or rectangular, with a jagged or smooth edge. Each foot 19 is larger than or the same size crosswise as relative hole 12, is initially separate from shaft 18, and, when constructing mat 7, is placed substantially contacting ground 2 beneath mat 7 and coaxial with hole 12. Each shaft 18 therefore only engages foot 19 to form foundation pile 9 when shaft 18 is inserted through hole 12.

To ensure sufficiently firm mechanical connection of each shaft 18 to foot 19, foot 19 has a connecting member 22, which engages shaft 18 to fix shaft 18 transversely to foot 19. For example, in the embodiments shown, each connecting member 22 is defined by a cylindrical tubular member, which extends perpendicularly upwards from plate 21, and is sized to relatively loosely engage a bottom portion of inner conduit 20 of shaft 18. Obviously, connecting member 22 may be formed differently.

A bottom end portion of each guide tube 13 is fitted with at least one sealing ring 123 made of elastic material, and which engages the outer cylindrical surface of shaft 18 of foundation pile 9, when foundation pile 9 is fitted through corresponding hole 12.

When constructing mat 7, at least one injection conduit 24 is formed at each hole 12, is defined by a metal tube extending through mat 7, and has a top end projecting from mat 7, and a bottom end terminating adjacent to hole 12 and contacting a top surface of plate 21 of foot 19.

As shown in FIGS. 4 and 5, once mat 7 is completed, a foundation pile 9 is driven into ground 2 through each hole 12. More specifically, one foundation pile 9 is driven at a time, or at any rate a small number of foundation piles 9 are driven simultaneously, to minimize stress on mat 7.

Depending on the structural characteristics of mat 7, the characteristics of ground 2, and the characteristics of building 1, each foundation pile 9 is assigned a rated load, i.e. a weight that must be supported by foundation pile 9 without yielding, i.e. without breaking and/or sinking further into ground 2. To ensure the respective rated load is complied with, each foundation pile 9 is normally driven until it is unable to withstand thrust by pile-driving device 10 greater than the rated load without sinking further into ground 2. This operating mode is made possible by driving one foundation pile 9 at a time into ground 2, so that, when driving in foundation pile 9, practically the whole weight of mat 7 and building 1 can be used as a reaction force to the thrust of pile-driving device 10. When possible, each foundation pile 9 is driven with a force equal to 1.5-3 times the rated load of foundation pile 9, thus ensuring maximum safety of building 1 both during and at the end of the lift. Alternatively, the load of each foundation pile 9 is tested before the lift, by subjecting it to 1.5-3 times the rated load, to allow foundation pile 9 to mature.

The way in which each foundation pile 9 is driven into ground 2 will now be described with particular reference to FIG. 5A.

To drive foundation pile 9 into ground 2, shaft 18 is first inserted through hole 12 to engage (as described above) foot 19 located beneath mat 7, in contact with ground 2 and coaxial with hole 12. Once shaft 18 engages foot 19 to define foundation pile 9, a pile-driving device 10 is set up over foundation pile 9, cooperates with the top end of foundation pile 9, and is connected to ties 16. In a different embodiment not shown, pile-driving device 10 may be connected to guide tube 13.

In one possible embodiment shown in FIG. 5A, pile-driving device 10 comprises a hydraulic jack 25 located between the top end of foundation pile 9 and a top plate 26, which is fitted through with ties 16, and has a number of through holes 27 to slide freely along ties 16. Upward slide of top plate 26 is arrested by a number of nuts 28 screwed to ties 16 over top plate 26 using a torque wrench, so nuts 28 are all tightened equally and so act symmetrically and in balanced manner.

Once connected to respective foundation pile 9 as described above, pile-driving device 10 is operated to expand and exert static thrust on foundation pile 9 to drive foundation pile 9 into ground 2. The reaction force to the thrust exerted by pile-driving device 10 is provided by the weight of mat 7 and building 1, and is transmitted by ties 16, which act as reaction members by maintaining a fixed distance between top plate 26 and mat 7 as hydraulic jack 25 expands, thus driving in foundation pile 9.

Obviously, pile-driving device 10 may be formed differently, providing it exerts static thrust on foundation pile 9 to drive foundation pile 9 into ground 2. For example, pile-driving device 10 may be of the type described in Patent Application IT20043000792, which is included herein by way of reference.

As foundation pile 9 is driven into ground 2, foot 19 forms in ground 2 a channel 29 of substantially the same transverse shape and size as foot 19, and which comprises an inner cylindrical portion engaged by shaft 18, and a substantially clear outer tubular portion. Simultaneously with the sinking of foundation pile 9 into ground 2, substantially plastic cement material 30 is pressure-injected along injection conduit 24 into the outer tubular portion of channel 29. More specifically, cement material 30 is substantially defined by microconcrete for fluidity and smooth pressure-injection along injection conduit 24. Sealing ring 123 prevents the pressure-injected cement material 30 from leaking upwards through the gap between the outer surface of shaft 18 and the inner surface of guide tube 13.

If ground 2 has a tendency to shrink (as in the case of peat layers), substances (e.g. bentonite) may be added to cement material 30 to reduce friction (and therefore adhesion) of ground 2 with respect to cement material 30 as it dries, and so allow ground 2 to shrink freely and naturally with time. Waterproofing substances may also be added to cement material 30 to make it substantially waterproof even prior to curing. This is necessary when foundation pile 9 is sunk through groundwater, particularly high-pressure and/or relatively fast-flowing groundwater, and prevents cement material 30 from being washed away and so degraded. Tests also show that, when working through groundwater, it is important to inject cement material 30 at higher than the water pressure, to avoid the formation of breaks in cement material 30.

As stated, each shaft 18 is divided into segments, which are driven successively, as described above, through hole 12 and joined to one another. More specifically, once a first segment of shaft 18 is driven, pile-driving device 10 is detached from the top end of the first segment to insert a second segment, which is joined end to end to the first (typically using a cold-force-fitted connecting sleeve, or welded with a connecting sleeve in between); and pile-driving device 10 is then connected to the top end of the second segment to continue the driving cycle. The segments forming each shaft 18 are normally identical, but, in certain situations, may differ in length, shape or thickness.

As shown in FIG. 9, once all the foundation piles 9 are driven, building 1 is raised.

To do this, each foundation pile 9 is fitted with a lifting device 11 resting on the top end of foundation pile 9 on one side, and connected to ties 16 on the other side. In actual use, each lifting device 11 is operated to produce, between foundation pile 9 and mat 7, static thrust which is transmitted to mat 7 by ties 16.

Figures 10A, 10B, 10C:
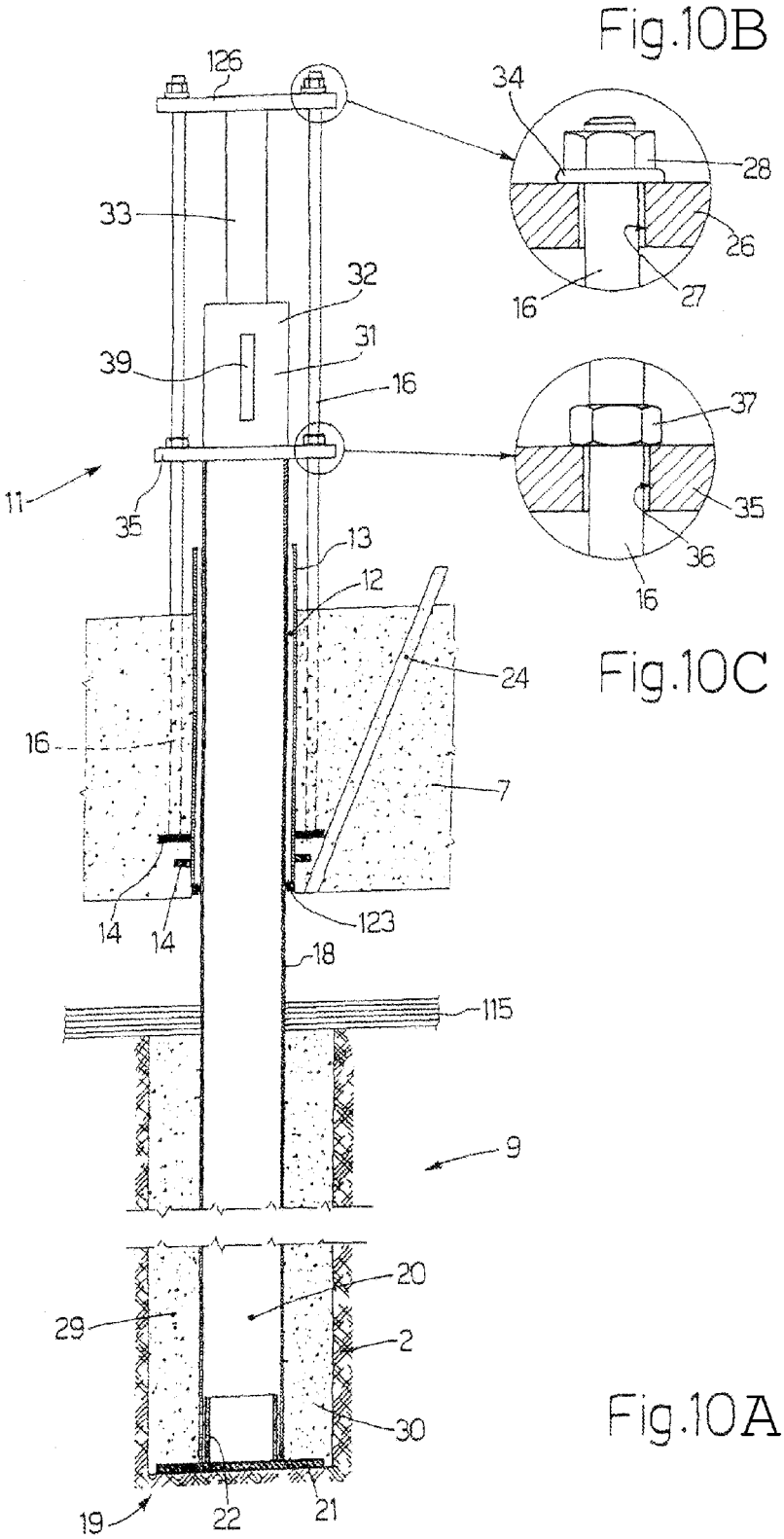
FIG. 10A shows a schematic lateral section of a foundation pile connected to a lifting device and FIGS. 10B and 10C show two enlarged views of respective portions of FIG. 10A.
Figure 11:
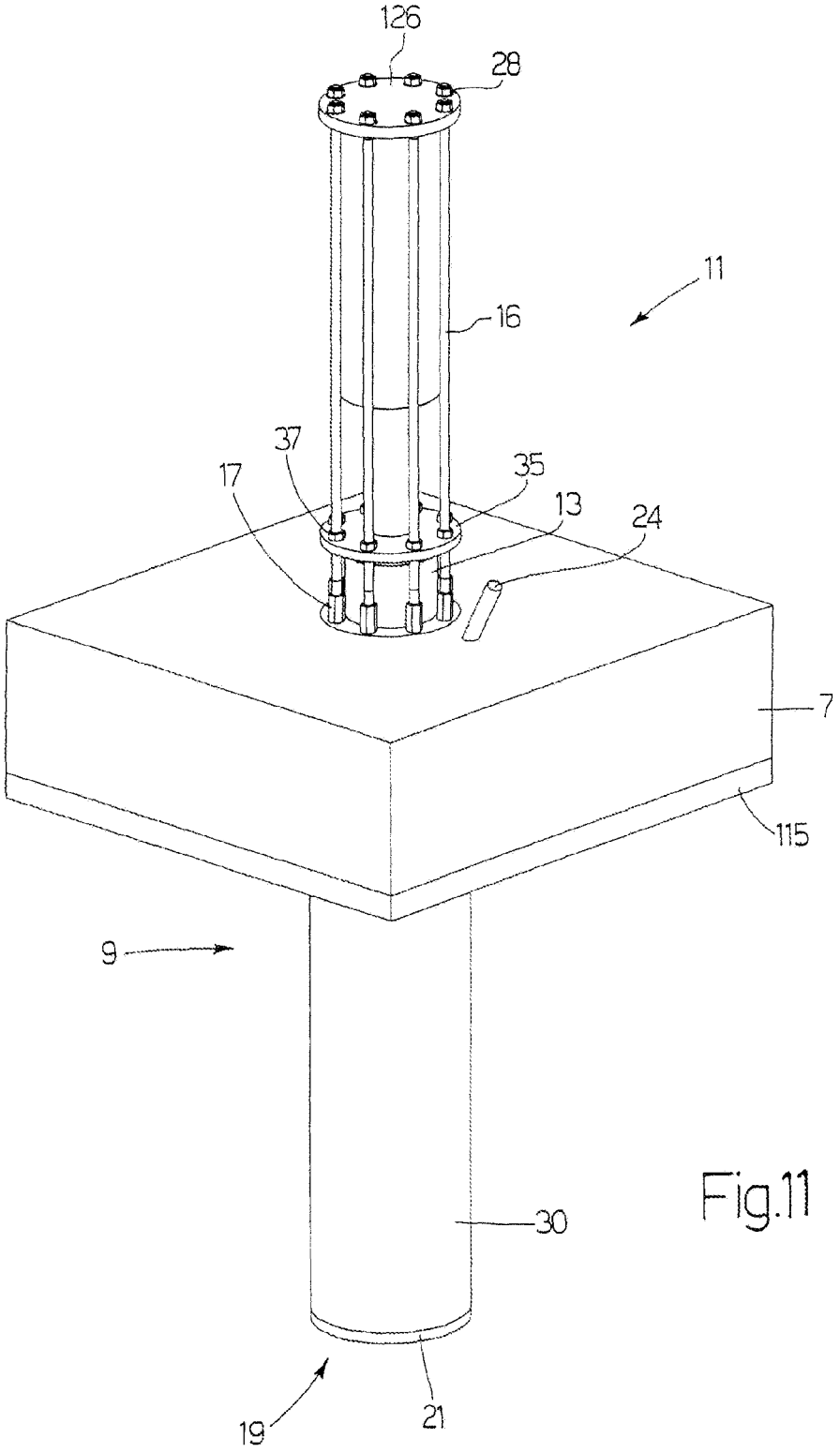
FIG. 11 shows a schematic view in perspective of a foundation pile connected to a lifting device.

As shown in FIGS. 10A and 11, each lifting device 11 comprises a hydraulic jack 31 in turn comprising a cylinder 32, from the top end of which extends a movable rod 33. Each hydraulic jack 31 is located between a bottom plate 35 which rests on the top end of foundation pile 9, is fitted through with ties 16, and has a number of through holes 36 to slide freely along ties 16—and top plate 126, which is fitted through with ties 16 and has a number of through holes 27 to slide freely along ties 16. Upward slide of top plate 126 is arrested by a number of nuts 28 screwed to ties 16 over top plate 126. At least one Belleville washer 34 is preferably interposed between each nut 28 and top plate 126, and deforms elastically to allow top plate 126 to tilt slightly with respect to ties 16.

In actual use, each hydraulic jack 31 is operated to expand and so exert thrust, between foundation pile 9 and mat 7, which is transmitted to mat 7 by ties 16, which act as reaction members by maintaining a fixed distance between top plate 126 and mat 7 as hydraulic jack 31 expands.

In a preferred embodiment, ties 16 are fitted with safety nuts 37 located over and kept close to bottom plate 35 to limit downward travel of mat 7 in the event of a breakdown (hydraulic failure, resulting in loss of pressure, or mechanical failure) of hydraulic jack 31. Safety nuts 37 are preferably tightened using a torque wrench, so they are all tightened equally and so function symmetrically and in balanced manner.

As shown in FIG. 9, once all the lifting devices 11 are set up as described above, hydraulic jacks 31 can be operated to commence raising building 1. Depending on the height to which the building is to be raised, shaft 18 of each foundation pile 9 may be either a one-piece body, or comprise a number of connected tubular segments, which are inserted successively through hole 12 and joined to one another as building 1 is raised with respect to ground 2. In other words, on reaching the end of a first segment of shaft 18, lifting device 11 is detached from the top end of the first segment to insert a second segment, which is butt welded to the first (possibly with a connecting piece in between); and lifting device 11 is then connected to the top end of the second segment to continue the lift cycle.

Figure 12:
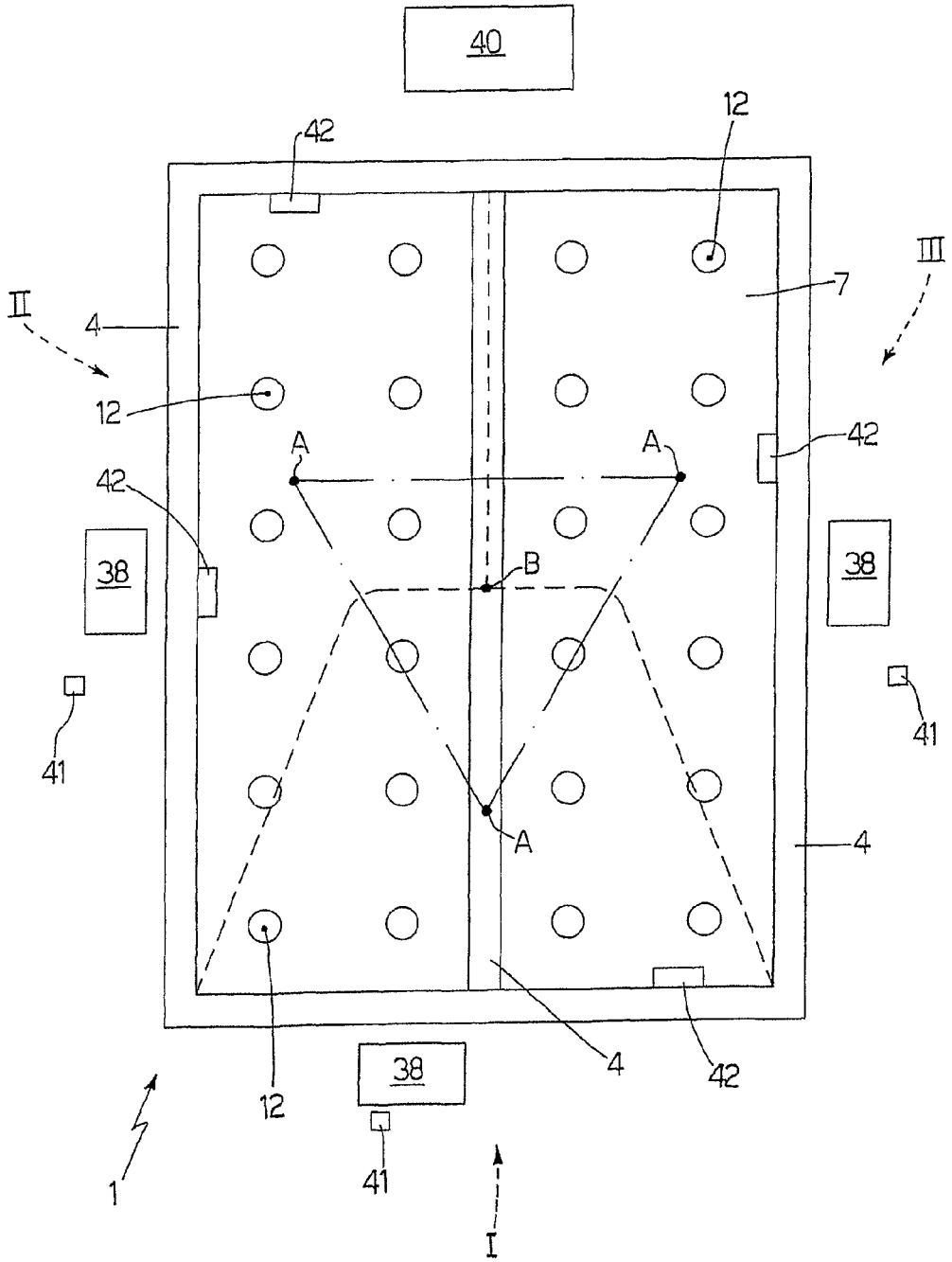

In one possible embodiment shown in FIG. 12, foundation piles 9 and lifting devices 11 are divided into three equal, symmetrical, independent work groups (shown by dash lines in FIG. 12 and indicated by Roman numerals I, II, III). The work groups should be as equal as possible, i.e. should comprise roughly the same number of lifting devices 11, and be as symmetrical as possible, i.e. the thrust barycentres A of the three work groups should correspond to the vertices of a preferably equilateral triangle with its centre at the barycentre B of the weight of building 1 and mat 7. The above requirements in terms of equality and symmetry of the three work groups are not strictly mandatory, but should be complied with as closely as possible to minimize mechanical stress of building 1.

Lifting devices 11 of each work group are connected to a respective hydraulic central control unit 38, which supplies all the hydraulic jacks 31 and can cut of pressurized-oil supply to each hydraulic jack 31 individually. In other words, each hydraulic central control unit 38 supplies all the hydraulic jacks 31 in its own group with pressurized oil pumped by an oil pump (not shown), and can also cut off pressurized-oil supply to one or more hydraulic jacks 31 by closing respective on-off solenoid valves (not shown). It is important to note that hydraulic central control unit 38 of one work group is independent of hydraulic central control units 38 of the other work groups. Each hydraulic jack 31 is connected to a respective linear position sensor 39 (typically a linear encoder) shown schematically in FIG. 10A, and which measures the relative position (i.e. distance) between the top surface of mat 7 and bottom plate 35 to real-time measure the actual lift of mat 7. Each linear position sensor 39 may, for example, be located between a tie 16 and bottom plate 35. Alternatively, each linear position sensor 39 measures the position of rod 33 with respect to cylinder 32 of respective hydraulic jack 31 to real-time measure the actual expansion of hydraulic jack 31, which is related to the actual lift of mat 7. In a different embodiment, as opposed to connecting a linear position sensor 39 to each hydraulic jack 31, a common linear position sensor 39 may be connected to a close group of hydraulic jacks 31 to reduce the number of linear position sensors 39 required and so reduce cost and simplify the system.

At this point, the actual lift of building 1 is commenced. The hydraulic circuits of hydraulic jacks 31 in each work group are parallel connected to the oil pump (not shown) by respective hydraulic central control unit 38, and building 1 is raised by simultaneously expanding the hydraulic jacks 31 of one work group at a time, while the hydraulic jacks 31 of the other two work groups remain idle. In other words, to raise building 1, hydraulic jacks 31 of one work group at a time are expanded simultaneously to raise the building 0.5-50 mm at a time. This causes building 1 to rotate slightly with respect to the horizontal, which is permitted by the compensating effect of both the elasticity of the system as a whole, and deformation of Belleville washers 34. In other words, as each rotation of building 1 is induced by lifting devices 11 of one work group, Belleville washers 34 in the other two work groups not involved in the lift expand or are compressed slightly to accompany the difference in height of the various parts of building 1.

Statically speaking, building 1, reinforced with mat 7, must be thought of as resting on three points (thrust barycentres A) having a spherical hinge (simulated by Belleville washers 34), so that lifting can be performed by activating one work group at a time, and the whole building 1 rotates about the axis through thrust barycentres A of the other two idle work groups, without producing any hyperstatic constraints.

Building 1 is normally raised at a very slow speed (calculated at thrust barycentres A of the three work groups) to maintain isostatic conditions. Working at slow speed ensures a wide margin of safety during the lift, in that, by totally eliminating dynamic forces, reference can be made to static-condition standards. Moreover, the lift can be interrupted at any time to monitor, calibrate or make changes to the electric control system or hydraulic system.

At each lift step, building 1 normally tilts by fractions of a degree with respect to the vertical. The building 1 weight force component along the tilt plane is very small, and can easily be balanced (if necessary) by means of ties activated by hydraulic compensating jacks.

During the lift, the system is monitored constantly by a control unit 40 connected to pressure sensors 41 for measuring the actual pressure of hydraulic central control units 38, to position sensors 39 to measure the actual extension of each hydraulic jack 31, and to a number of wide-base strain gauges 42 fitted to supporting walls 4 of building 1 to measure the stress induced by the lift on supporting walls 4. As opposed to using wide-base strain gauges 42 to measure the stress induced by the lift on supporting walls 4, flat measuring jacks (not shown) may be inserted inside supporting walls 4 (e.g. by temporarily removing the mortar between two superimposed bricks in the walls to form a gap in which to insert the flat measuring jacks). During the lift, pressure sensors record the fluid pressure in the flat measuring jacks to accurately determine instantaneous compression on supporting walls 4, and so detect any unusual or excessive increase in compression on each supporting wall 4 when raising building 1.

During the lift, mat 7 is also monitored constantly by control unit 40, which is connected to a network of inclinometers (not shown) connected to mat 7 to real-time calculate a graph of deformation of mat 7, and is connected to a precision optical device (not shown) which monitors a number of topographical reference points to occasionally check the inclinometer data. In other words, control unit 40 monitors flexural deformation of mat 7 by means of a main system defined by the inclinometers, and by means of a redundant secondary system defined by the precision optical device.

It is important to note that flexural deformation mat 7 must be maintained within a very small range and, above all, absolutely stable throughout the lift, on account of it depending substantially on the inevitable distances (which remain constant at all times) between the weight distribution of building 1 and the thrust of lifting devices 11. If a predetermined maximum flexural deformation of mat 7 is exceeded during the lift, the thrust of lifting devices 11 must be balanced better.

Further trimming of mat 7 may be achieved by adjusting opposite posttensioning cables 8 capable of producing predetermined reactions.

As stated, when lifting building 1, control unit 40 controls respective hydraulic central control unit 38 to operate one group of lifting devices 11 at a time. Before expanding hydraulic jacks 31 of one group, control unit 40 establishes a lift value (normally 0.5-50 mm) for each lift step, and controls hydraulic central control unit 38 so that each hydraulic jack 31 in the group expands by exactly the predetermined lift step value. When each hydraulic jack 31 expands by exactly the predetermined lift step value (real-time measured by respective position sensor 39), control unit 40 controls hydraulic central control unit 38 to cut off oil supply to and stop expansion of hydraulic jack 31. In other words, control unit 40 feedback controls each hydraulic jack 31 using the actual lift step value as a feedback variable. At each lift step, the same predetermined lift step value is determined for all the hydraulic jacks 31, and expansion of each hydraulic jack 31 is stopped when the actual lift step value (measured by respective position sensor 39) equals the predetermined value.

By controlling each hydraulic jack 31 to expand by exactly the predetermined lift step value, it is not essential (though preferable to reduce mechanical stress on building 1) that the three work groups be as equal as possible, i.e. comprise roughly the same number of lifting devices 11, and be as symmetrical as possible, i.e. that the thrust barycentres A of the three work groups correspond to the vertices of a triangle with its centre at the barycentre B of the weight of building 1 and mat 7.

In a different embodiment, as opposed to being divided into three independent groups, lifting devices 11 are divided into a different number of groups, each comprising at least one lifting device 11. In other words, lifting devices 11 are operated individually (i.e. each group comprises one lifting device 11) or in small groups, each comprising a small number of (3-7) closely grouped lifting devices 11, so that each expands by exactly the predetermined lift step value at each lift step. In other words, the lift of building 1 is divided into a number of successive lift steps, during each of which, hydraulic jacks 31 are all controlled to expand by exactly the predetermined lift step value as described above. As opposed to operating all the lifting devices 11, only one lifting device 11 or, at most, a small group (i.e. comprising a small number of closely grouped lifting devices 11) is operated at a time. This operating mode is advisable when the plan of building 1 is highly irregular and/or the structural characteristics of building 1 are unknown. In fact, by operating only one lifting device 11 (or at any rate a small number of closely grouped lifting devices 11) at a time, only minor stress is exerted on building 1 and it is therefore easier to keep the maximum stress on building 1 under control. In this case, each lift step provides for a very small amount of lift, normally ranging between 0.5 and 50 mm, to ensure very little stress on building 1 during the lift.

In one embodiment, as each lifting device 11 is running, the hydraulic pressure of the corresponding hydraulic jack 31 is recorded, and pressurized-fluid supply to hydraulic jack 31 of the currently operating lifting device 11 is cut off if the hydraulic pressure of hydraulic jack 31 exceeds a predetermined maximum threshold value, so as to avoid overloading lifting device 11 and the structures acted on by lifting device 11 during the lift. Similarly, as each lifting device 11 is running, the hydraulic pressure of the idle hydraulic jacks 31 close to the operating lifting device 11 is recorded, and pressurized-fluid supply to the hydraulic jack 31 of the currently operating lifting device 11 is cut off if the hydraulic pressure of the idle hydraulic jacks 31 close to the operating lifting device 11 falls below a predetermined minimum threshold value, so as to avoid excessively unloading the idle lifting devices 11 close to the operating lifting device 11.

One embodiment not shown also employs external position sensors independent of lifting devices 11 to accurately measure the actual lift of building 1. These position sensors measure the absolute displacement of mat 7 with respect to ground 2, and comprise a first part integral with ground 2, and a second part integral with mat 7. The lift measured by the external position sensors is exact, and may differ from the lift recorded by position sensors 39 fitted to hydraulic jacks 31, in that expansion of each hydraulic jack 31 may partly lift mat 7 and partly produce further sinking and/or deformation of foundation pile 9.

Figure 13:
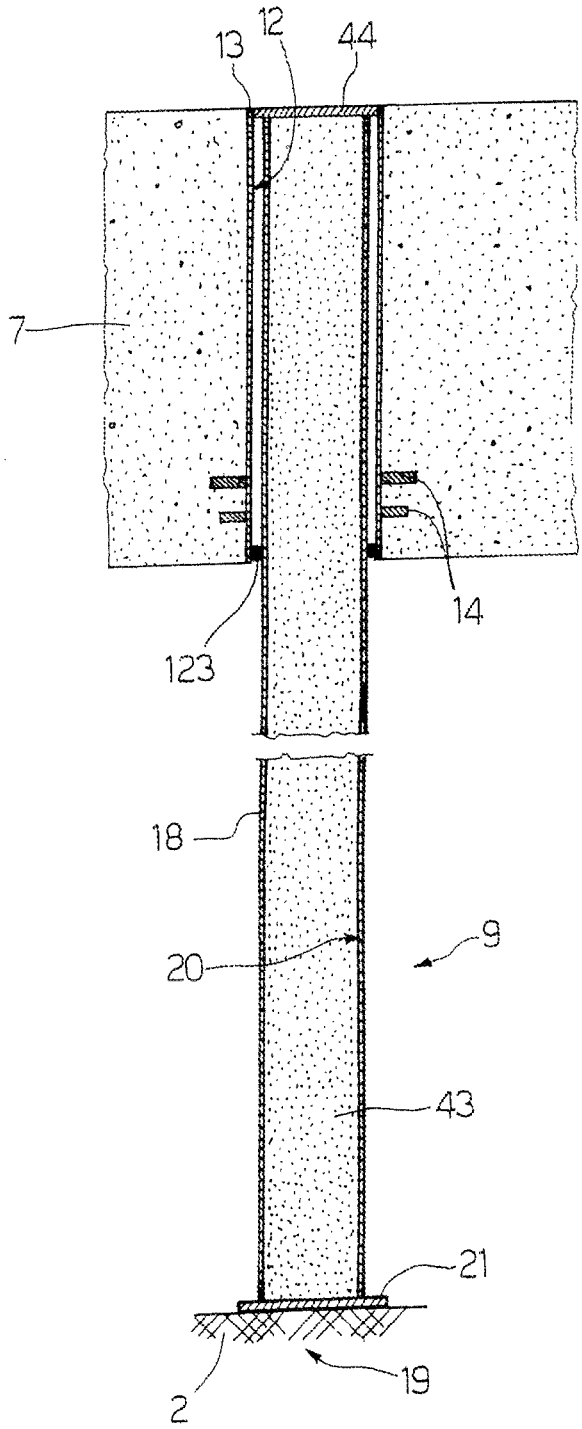
FIG. 13 shows a schematic lateral section of a foundation pile at the end of the lifting operation
Figure 14:
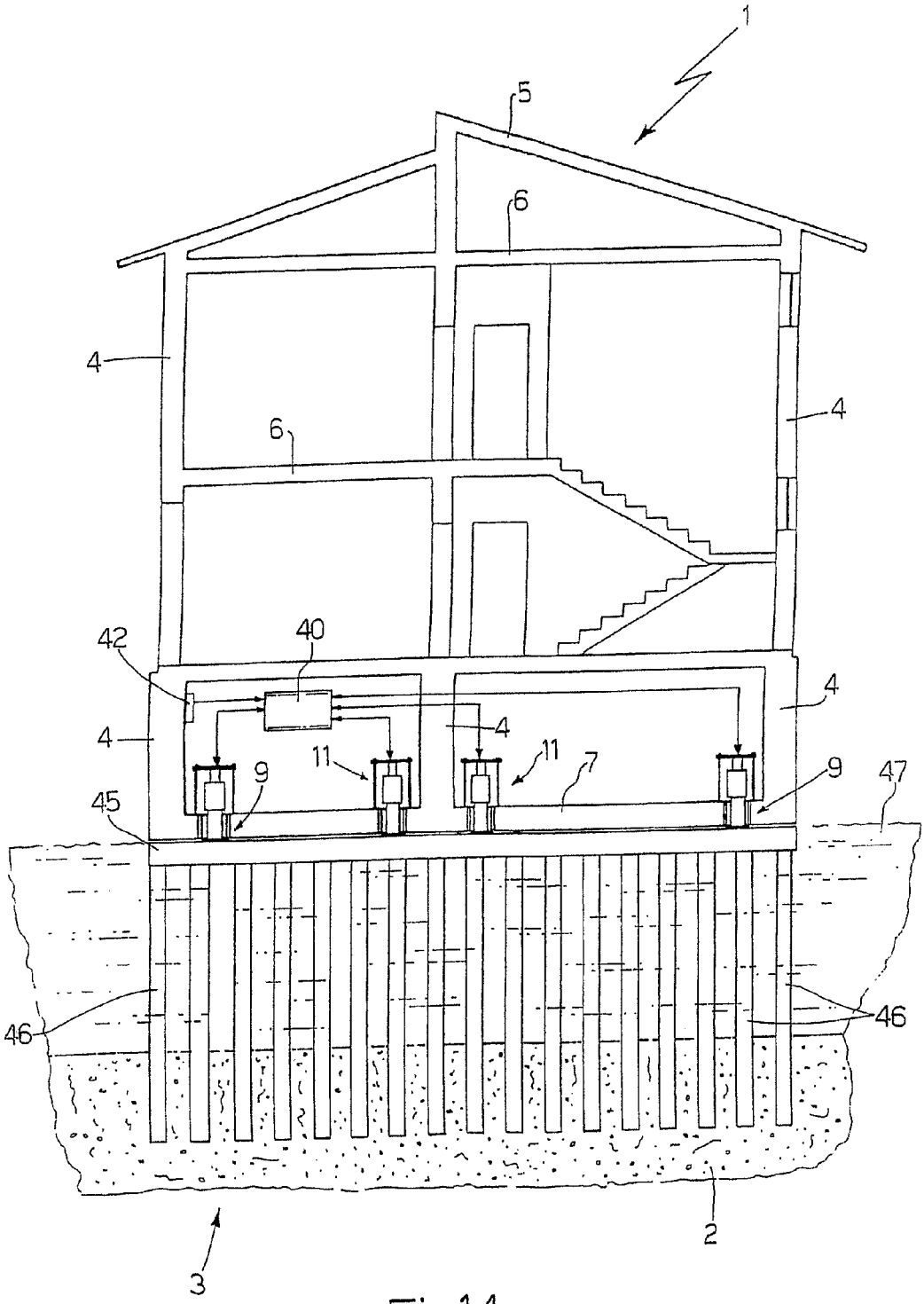
FIG. 14 shows a schematic section of a different building raised using the method according to the present invention.

As shown in FIG. 13, once lifting is completed, inner conduit 20 of each foundation pile 9 is filled with substantially plastic "concrete" 43. Once the inner conduit 20 of foundation pile 9 is filled, foundation pile 9 is fixed axially to mat 7 by securing (normally welding) to the top wall of guide tube 13 a circular or annular fastening plate 44 which is placed on top, to engage the top end, of foundation pile 9, so that the top end of foundation pile 9 rests against fastening plate 44 which is integral with guide tube 13. Alternatively, each foundation pile 9 may be filled with concrete 43 before commencing the lift, so that, when raising the building, each pile 9 is capable of supporting a greater load without yielding and/or deforming.

In a different embodiment not shown, a body of elastic material (e.g. neoprene) is interposed, inside slide tube 15, between the top end of foundation pile 9 and fastening plate 47, normally to enhance the antiseismic characteristics of mat 7.

Each foundation pile 9 may also be fixed axially to mat 7 removably, to permit further lift of building 1 in the future.

Preferably, each foundation pile 9 is driven so that the top end is below the top surface of mat 7, and fastening plate 47 is substantially flush with the top surface of mat 7 when fixed to the top wall of slide tube 15, so the whole top surface of mat 7 can be walked on.

Before being fixed axially to mat 7, foundation pile 9 can be preloaded with a downward thrust of given intensity for as long as necessary to weld fastening plate 44 to guide tube 13. In other words, when welding fastening plate 44 to guide tube 13, downward thrust of given intensity is applied to foundation pile 9. Preloading foundation pile 9 when fixing it to mat 7 allows any yield of foundation pile 9 to emerge immediately as opposed to over the long term; the reason obviously being that correcting yield of one or more foundation piles 9 during installation is relatively cheap and straightforward, whereas doing it at the end of the job is much more complicated and expensive.

It should be pointed out that raising the building forms a space underneath mat 7, which may be used to build a basement. Alternatively, the space between the underside of mat 7 and ground 2 may be filled with conventional concrete or nonconventional materials (e.g. polyurethane foam). If the building is raised a considerable height (about a meter), only the projecting part of foundation piles 9 may be covered to form actual supporting pillars, and filling limited to the areas beneath supporting walls 4; in which case, building 1 would be structurally similar to one built on piles.

In a different embodiment shown in FIG. 13, mat 7, as opposed to resting directly on ground 2, rests on a further foundation mat 45 having a large number of piles 46 driven into ground 2 beneath a stream or basin of water (e.g. a lagoon) 47. This solution is typical of a building 1 built on water, wherein piles 46 are driven into ground 2 beneath, and support building 1 above, the level of water 47. When mat 7 rests on a further mat 45, the feet 19 of at least some of foundation piles 9 obviously rest on further mat 45; in which case, the foundation piles 9 resting on further mat 45 are obviously not driven into ground 2.

In a further embodiment not shown, as opposed to resting directly on ground 2, foundation piles 9 (and hence mat 7) rest on further foundation piles driven beforehand, or on any other type of existing support under foundation mat 7. In other words, feet 26 of at least some of foundation piles 9 rest on further foundation piles driven beforehand, or on any other type of existing support under foundation mat 7.

In one possible embodiment, after driving in foundation piles 9, and before raising building 1 with respect to ground 2, ground 2 and any existing foundation structures underneath mat 7 are removed, so that mat 7 and the whole of building 1 above the underside of mat 7 are supported solely by foundation piles 9. In other words, everything mat 7 rests on (ground 2 and any existing foundation structures), i.e. everything beneath mat 7, is removed before raising building 1 with respect to ground 2, so that, before raising building 1 with respect to ground 2, mat 7 and the whole of building 1 above the underside of mat 7 are supported solely by foundation piles 9.

Figure 15:
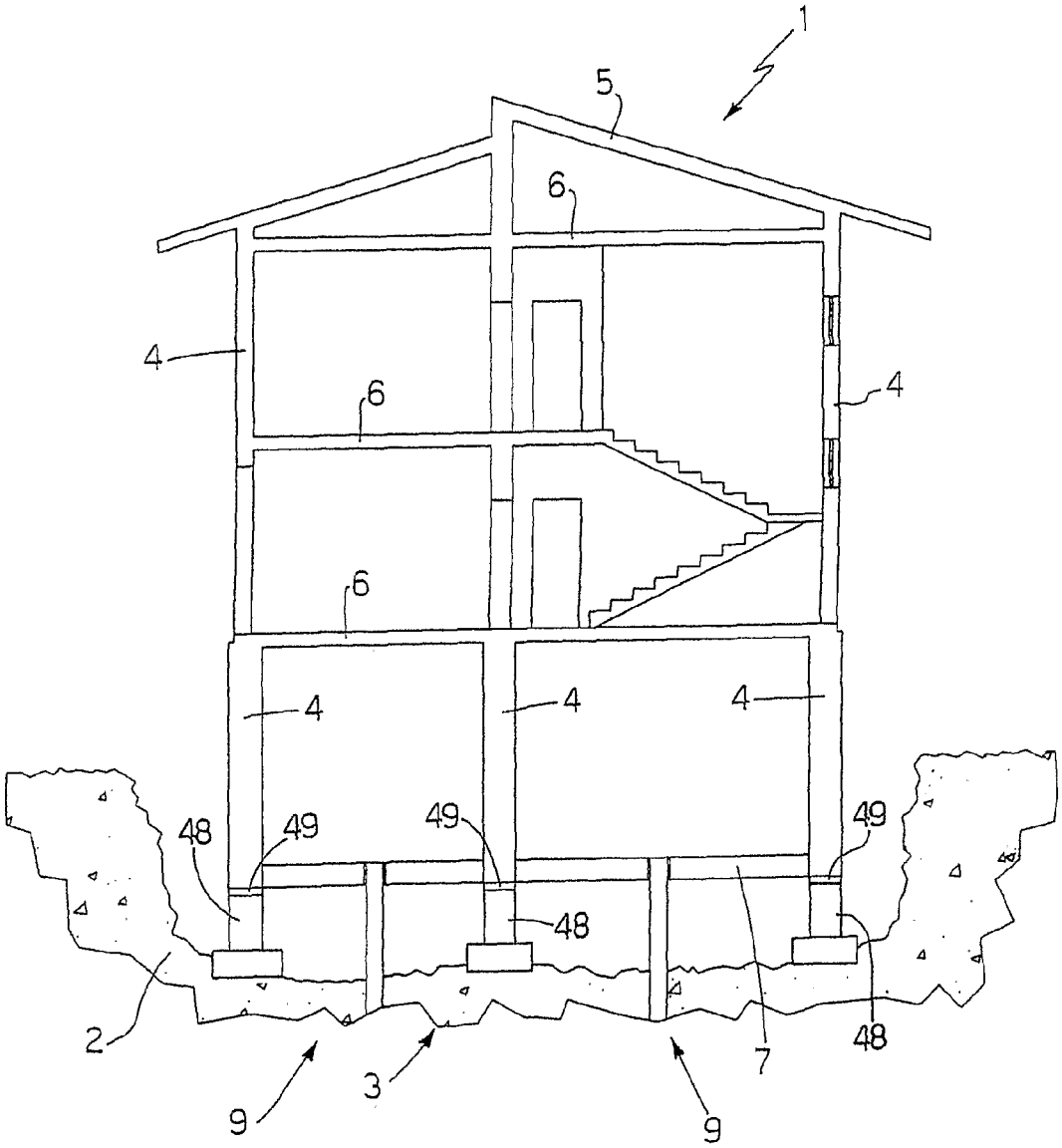

As shown in FIG. 15, once the building is raised, continuity between the old foundation structure 3 and supporting walls 4 of building 1 may be restored by additional masonry 48. This ensures greater safety and endurance, by providing building 1 with two foundation systems, each capable of supporting building 1 on its own. More specifically, flat jacks 49 are interposed between additional masonry 48 and supporting walls 4 of building 1, and are expanded to at least partly load the old foundation structure 3. Each flat jack 49 comprises two metal sheets welded to each other to form a pocket in between, which is filled with pressurized fluid to expand flat jack 49. The fluid used to fill the pocket of flat jack 49 is preferably a resin that tends to set with time to stabilize the situation regardless of the endurance of the pocket.

In the above embodiment, mat 7 is constructed entirely just before the lift. In an alternative embodiment, at least part of mat 7 may already be built; in which case, holes 12 are core-drilled.

In the embodiments shown in the drawings, building 1 has only supporting walls 4. In a different embodiment not shown, building 1 may also have other supporting members (typically, supporting pillars) together with or instead of supporting walls 4.

If building 1 shares one or more supporting walls 4 with adjoining buildings, all the floors 6 connected to the shared supporting wall 4 must be detached from it to lift floors 6 with respect to the shared supporting wall 4, and must be reconnected to the shared supporting wall 4 after the lift. Before being detached from a shared supporting wall 4, floor 6 must obviously be adequately supported by a temporary metal frame adjacent to but not contacting the shared supporting wall 4. The above method may also be applied to large buildings (e.g. with a base of over 1000 sq. m) which are divided into a number of parts raised separately.

The lifting method described above may obviously be used to advantage to raise any type of building structure other than a building, e.g. a bridge.

Figure 16:
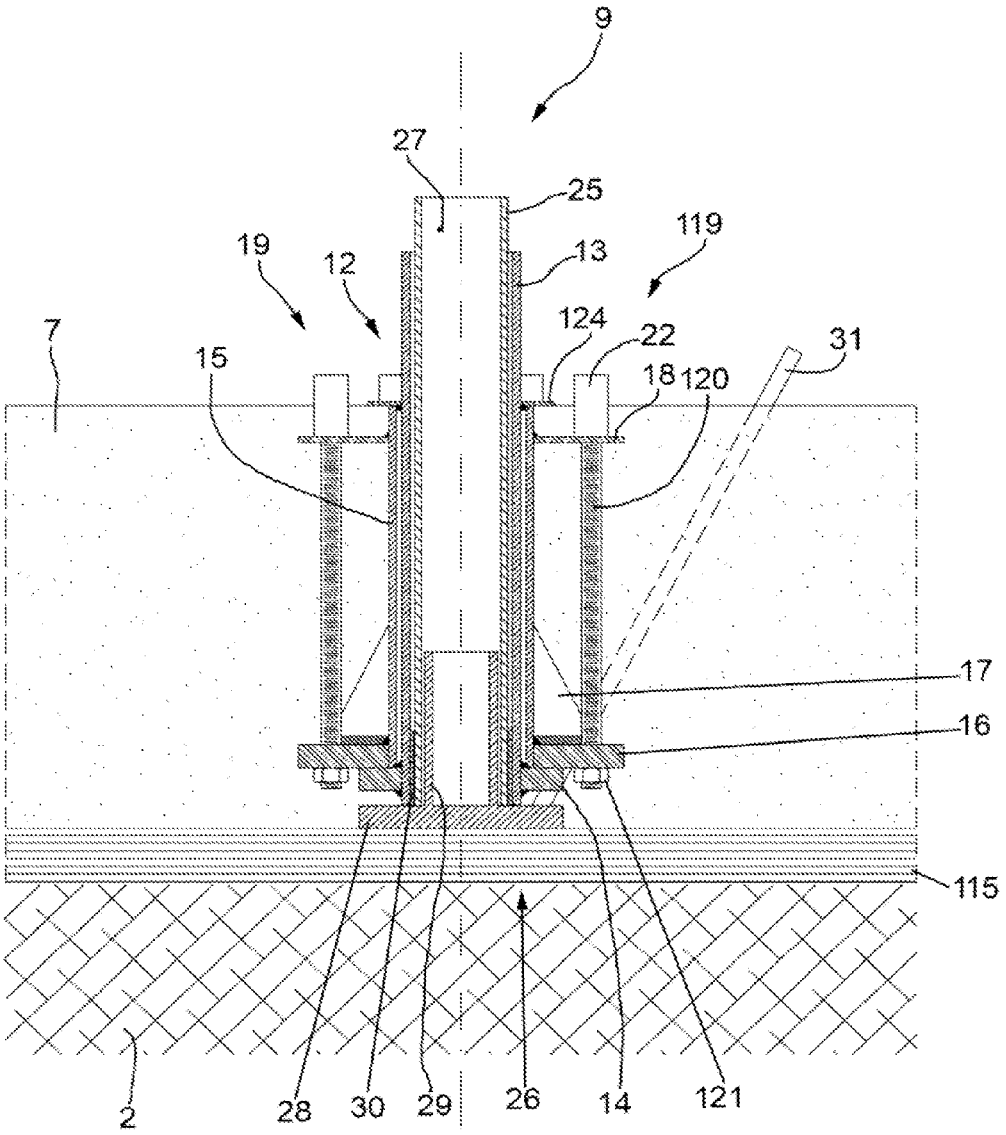
FIG. 16 shows a larger-scale lateral section of the initial configuration according to a different embodiment of a foundation pile before being driven into the ground.

In a different embodiment shown in FIG. 16, for each foundation pile 9, mat 7 comprises a vertical hole 12 (of cylindrical or other section) lined with a metal guide tube 13, which has a to portion projecting upwards from mat 7, and an anchoring flange 14 embedded in a bottom portion of mat 7 and fixed (typically welded) centrally to an outer surface of guide tube 13.

Each guide tube 13 is housed inside a slide tube 15 which is coaxial with and surrounds guide tube 13, and is axially slidable with respect to guide tube 13 to slide axially with respect to guide tube 13 and integrally with mat 7 when raising mat 7 with respect to ground 2 (as described in detail below). It is important to note that whereas a top portion of each guide tube 13 projects upwards from mat 7, each slide tube 15 is flush with mat 7; and each guide tube 13 extends downwards to a bottom wall of mat 7, whereas the bottom of each slide tube 15 stops short of the bottom wall of mat 7.

Each slide tube 15 has an annular bottom anchoring flange 16 embedded in mat 7, above anchoring flange 14 of guide tube 13, and fixed (normally welded) centrally to an outer surface of slide tube 15. In other words, anchoring flange 14 of each guide tube 13 is located beneath slide tube 15, and rests on a bottom wall of slide tube 15. The fact that anchoring flange 14 of each guide tube 13 rests on the bottom wall of slide tube 15 is important in that, in so doing, anchoring flange 14 also provides for sealing off the bottom of the annular gap between the outer surface of guide tube 13 and the inner surface of slide tube 15, and so keeping out impurities (such as water, concrete, etc.).

Each bottom anchoring flange 16 preferably has a number of (e.g. six) braces 17, which are arranged radially and symmetrically about slide tube 15, are right-triangular in shape, and are fixed (normally welded) to an outer surface of slide tube 15 and to a top surface of bottom anchoring flange 16.

Each slide tube 15 also has an annular top locating flange 18 embedded in mat 7 and fixed (normally welded) centrally to an outer surface of slide tube 15. In a different embodiment not shown, at least one intermediate anchoring flange may be provided between bottom anchoring flange 16 and top locating flange 18.

Each through hole 12 is surrounded by a number of (e.g. six) anchors 119 arranged axially and symmetrically about slide tube 15 (i.e. about guide tube 13), projecting upwards from mat 7, and fastened to slide tube 15. Anchors 119 are defined by respective threaded metal bars 120 fitted through top locating flange 18 of slide tube 15 and fastened to bottom anchoring flange 16 of slide tube 15. For each bar 120, bottom anchoring flange 16 has a through hole through which bar 120 is fitted; and a bottom end of bar 120 has a nut 121 which is screwed to bar 120 to prevent it sliding upwards. Similarly, for each bar 120, top locating flange 18 has a through hole through which bar 120 is fitted; and to the top portion of each bar 120 above top locating flange 18 is screwed a connecting sleeve 22 by which to fasten stays 23 (FIG. 17) to bars 20, i.e. to anchors 119.

In a preferred embodiment, in each through hole 12, the top end of each anchor 19 (i.e. connecting sleeve 22) is covered, when pouring mat 7, with a protective cover, e.g. a tubular member of foam rubber or similar, to prevent the concrete pour of mat 7 from fouling the top end of each anchor 19.

Each slide tube 15 preferably has a sealing ring 124 which is fixed (normally welded) to slide tube 15, is located at the top of slide tube 15 (i.e. contacting a top wall of slide tube 15), and rests internally on an outer surface of guide tube 13 to seal the top of the annular gap between the outer surface of guide tube 13 and the inner surface of slide tube 15 and so keep out any impurities (such as dust, water, concrete, etc.)

Each foundation pile 9 is a metal pile, and comprises a substantially constant-section shaft 25 normally defined by a number of tubular segments of equal length connected end to end (normally using cold-force-fitted connecting sleeves, or welded with connecting sleeves in between); and a wide bottom foot 26 defining the bottom end of foundation pile 9. Shaft 25 may obviously be other than circular in section, and may be solid, e.g. defined by an I-beam.

Each shaft 25 is tubular, has a through inner conduit 27, and is smaller across (in diameter) than the inside hole of relative guide tube 13 to fit relatively easily through guide tube 13. Each foot 26 is defined by a flat, substantially circular plate 28 with a preferably jagged outer edge. Flat plate 28, however, may obviously be shaped differently, e.g. oval, square or rectangular, with a jagged or smooth edge. Each foot 26 is larger across (in diameter) than shaft 25, is normally larger across (in diameter) than the inside hole of relative guide tube 13, is initially separate from shaft 25, and, when constructing mat 7, is placed substantially contacting ground 2 beneath mat 7 and coaxial with through hole 12, so that shaft 25 only engages foot 26 to form foundation pile 9 when shaft 25 is inserted through hole 12.

To ensure sufficiently firm mechanical connection of each shaft 25 to foot 26, foot 26 has a connecting member 29, which engages shaft 25 to fix shaft 25 transversely to foot 26. For example, in the embodiments shown, each connecting member 29 is defined by a cylindrical tubular member, which extends perpendicularly upwards from plate 28, and is sized to relatively loosely engage a bottom portion of inner conduit 27 of shaft 25.

A bottom end portion of each guide tube 13 is fitted with at least one sealing ring 30 made of elastic material, and which is fixed to an inner wall of guide tube 13, is located between an inner wall of guide tube 13 and an outer wall of foundation pile 9, and presses against an outer surface of shaft 25 of foundation pile 9, as foundation pile 9 is driven in, to prevent extraneous material from working its way up inside the annular gap between the inner wall of guide tube 13 and the outer wall of foundation pile 9. In a different embodiment, sealing ring 30 may be eliminated.

When constructing mat 7, at least one injection conduit 31 is formed at each hole 12, is defined by a metal tube extending through mat 7, and has a top end projecting from mat 7, and a bottom end terminating adjacent to hole 12 and contacting a top surface of plate 28 of foot 26 of foundation pile 9.

A layer 115 of relatively poor, so-called "lean", concrete is preferably interposed between mat 7 and ground 2, so plate 28 of foot 26 of foundation pile 9 rests on "lean" concrete layer 115.

Once mat 7 is completed, a foundation pile 9 is driven into ground 2 through each hole 12. More specifically, one foundation pile 9 is driven at a time, or at any rate a small number of foundation piles 9 are driven simultaneously, to minimize stress on mat 7.

Depending on the structural characteristics of mat 7, the characteristics of ground 2, and the characteristics of building 1, each foundation pile 9 is assigned a rated load, i.e. a weight foundation pile 9 must be capable of supporting without yielding, i.e. without breaking and/or sinking further into ground 2. To ensure the respective rated load is complied with, each foundation pile 9 is normally driven until it is unable to withstand thrust by pile-driving device 10 greater than the rated load without sinking further into ground 2. This operating mode is made possible by driving one foundation pile 9 at a time into ground 2, so that, when driving in foundation pile 9, practically the whole weight of mat 7 and building 1 can be used as a reaction force to the thrust of pile-driving device 10.

The way in which each foundation pile 9 is driven into ground 2 will now be described with particular reference to FIG. 17.

To drive foundation pile 9 into ground 2, shaft 25 is first inserted through guide tube 13 to engage (as described above) foot 26 located beneath mat 7, in contact with ground 2 and coaxial with guide tube 13. Once shaft 25 engages foot 26 to define foundation pile 9, a pile-driving device 10 is set up over foundation pile 9, cooperates with the top end of foundation pile 9, and is anchored to stays 23 to make it integral with mat 7. In a different embodiment not shown, pile-driving device 10 may be anchored to guide tube 13 to make it integral with mat 7.

Figure 17:
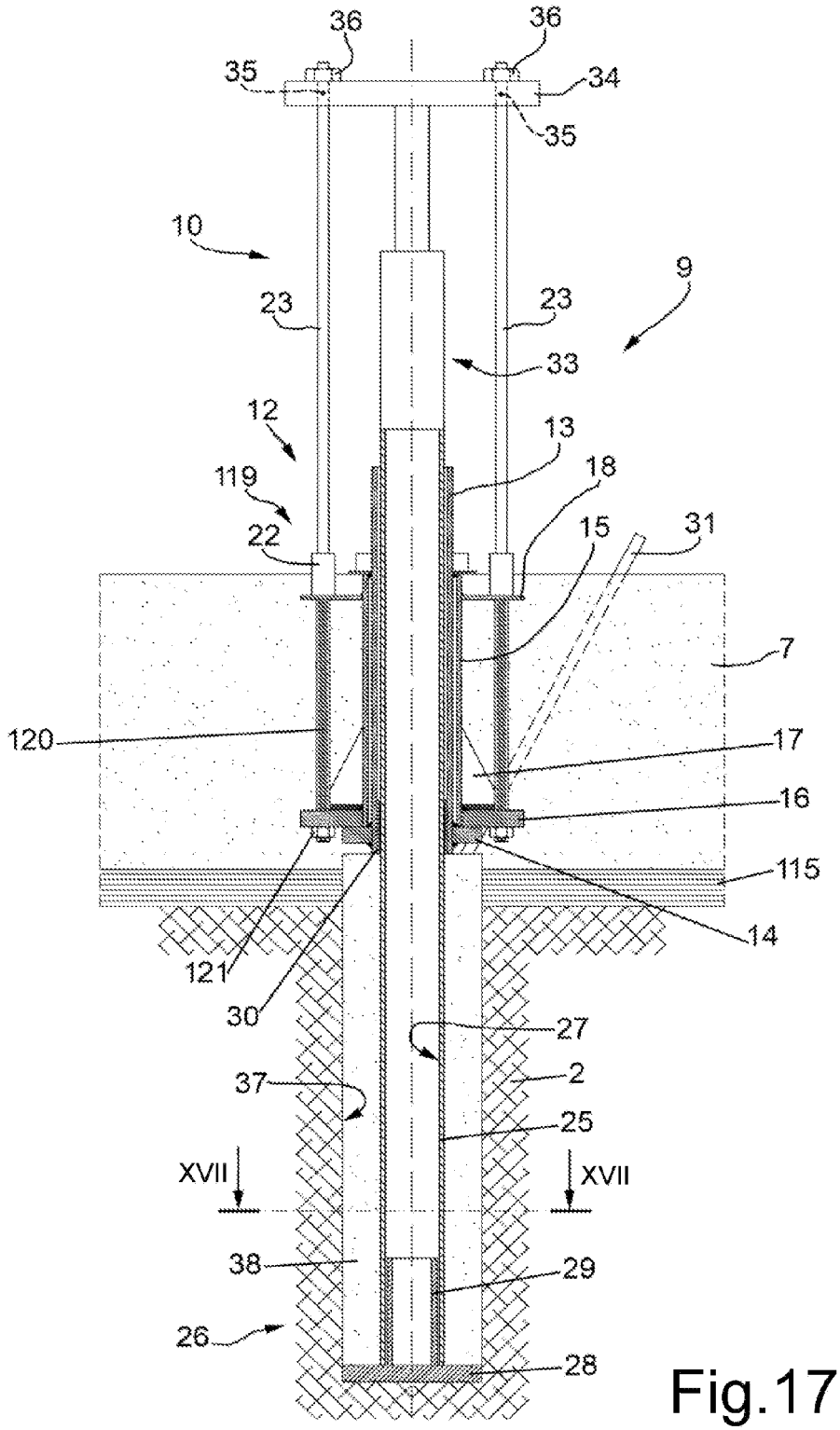
FIG. 17 shows a schematic lateral section of the FIG. 16 foundation pile as it is being driven into the ground.
Figure 18:
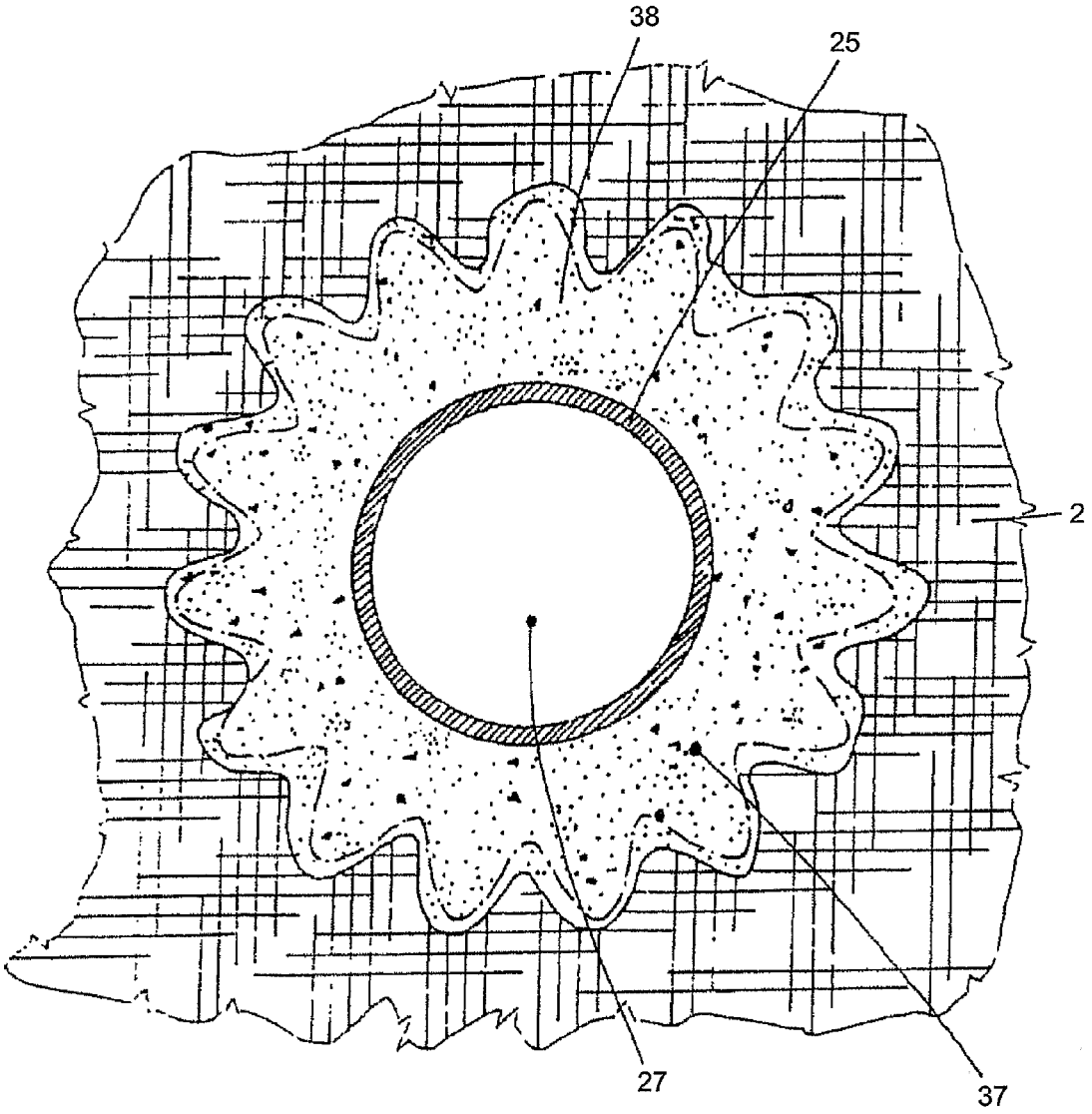
FIG. 18 shows a section along line XVIII-XVIII of the FIG. 16 foundation pile.

In one possible embodiment shown in FIG. 17, pile-driving device 10 comprises a hydraulic jack 33 located between the top end of foundation pile 9 and a top plate 34, which is fitted through with stays 23, and has a number of through holes 35 to slide freely along stays 23. Upward slide of top plate 34 is arrested by a number of nuts 36 screwed using a torque wrench to stays 23 over top plate 34, so nuts 36 are all tightened equally and so act symmetrically and in balanced manner.

Once connected to foundation pile 9 as described above, pile-driving device 10 is operated to expand and exert static thrust on foundation pile 9 to drive it into ground 2. The reaction force to the thrust exerted by pile-driving device 10 is provided by the weight of mat 7 and building 1, and is transmitted by stays 23, which act as reaction members by maintaining a fixed distance between top plate 34 and mat 7 as hydraulic jack 33 expands, thus driving in foundation pile 9.

Obviously, pile-driving device 10 may be formed differently, providing it exerts static thrust on foundation pile 9 to drive it into ground 2. For example, pile-driving device 10 may be of the type described in Patent Application WO2007071783A1, which is included herein by way of reference.

As foundation pile 9 is driven into ground 2, foot 26 forms in ground 2 a channel 37 of substantially the same shape and transverse size as foot 26. And simultaneously with the sinking of foundation pile 9 into ground 2, substantially plastic concrete 38 is pressure-injected along injection conduit 31 into channel 37. More specifically, concrete 38 is substantially defined by microconcrete for fluidity and smooth pressure-injection along injection conduit 31. Sealing ring 30 prevents pressure-injected concrete 38 from leaking upwards inside the gap between the outer surface of shaft 25 and the inner surface of guide tube 13.

If ground 2 has a tendency to shrink (as in the case of peat layers), additives (e.g. bentonite) may be added to concrete 38 to reduce friction (and therefore adhesion) of ground 2 with respect to concrete 38 after it sets, and so allow ground 2 to shrink freely and naturally with time. Waterproofing additives may be added to concrete 38 to make it substantially waterproof even prior to curing. This is necessary when foundation pile 9 is sunk through groundwater, particularly high-pressure and/or relatively fast-flowing groundwater, and prevents concrete 38 from being washed away and so degraded. Tests show that, when working through high-pressure groundwater, it is important to inject concrete at higher than the water pressure, to avoid the formation of breaks in concrete 38.

As stated, each shaft 25 is divided into segments, which are driven successively, as described above, through hole 12 in mat 7, and are joined together using cold-force-fitted connecting sleeves or welded with connecting sleeves in between. More specifically, once a first segment of shaft 25 is driven, pile-driving device 10 is detached from the top end of the first segment to insert a second segment, which is joined to the first segment using a cold-force-fitted connecting sleeve or butt welded with a connecting, sleeve in between; and pile-driving device 10 is then connected to the top end of the second segment to continue the driving cycle. The segments of each shaft 25 are normally identical, but, in certain situations, may differ in length, shape or thickness.

Other details or construction variations of foundation piles 9 are described in Patent Application WO2005028759A1 included herein by way of reference. More specifically, as described in more detail in Patent Application WO2005028759A1, in a different embodiment not shown, each foundation pile 9 comprises at least one further, lead-in, foot coaxial with and beneath foot 26, which has a central opening; and the lead-in foot comprises an elongated body extending upwards through the central opening in the main foot to engage the bottom end of shaft 25.

Figure 19:
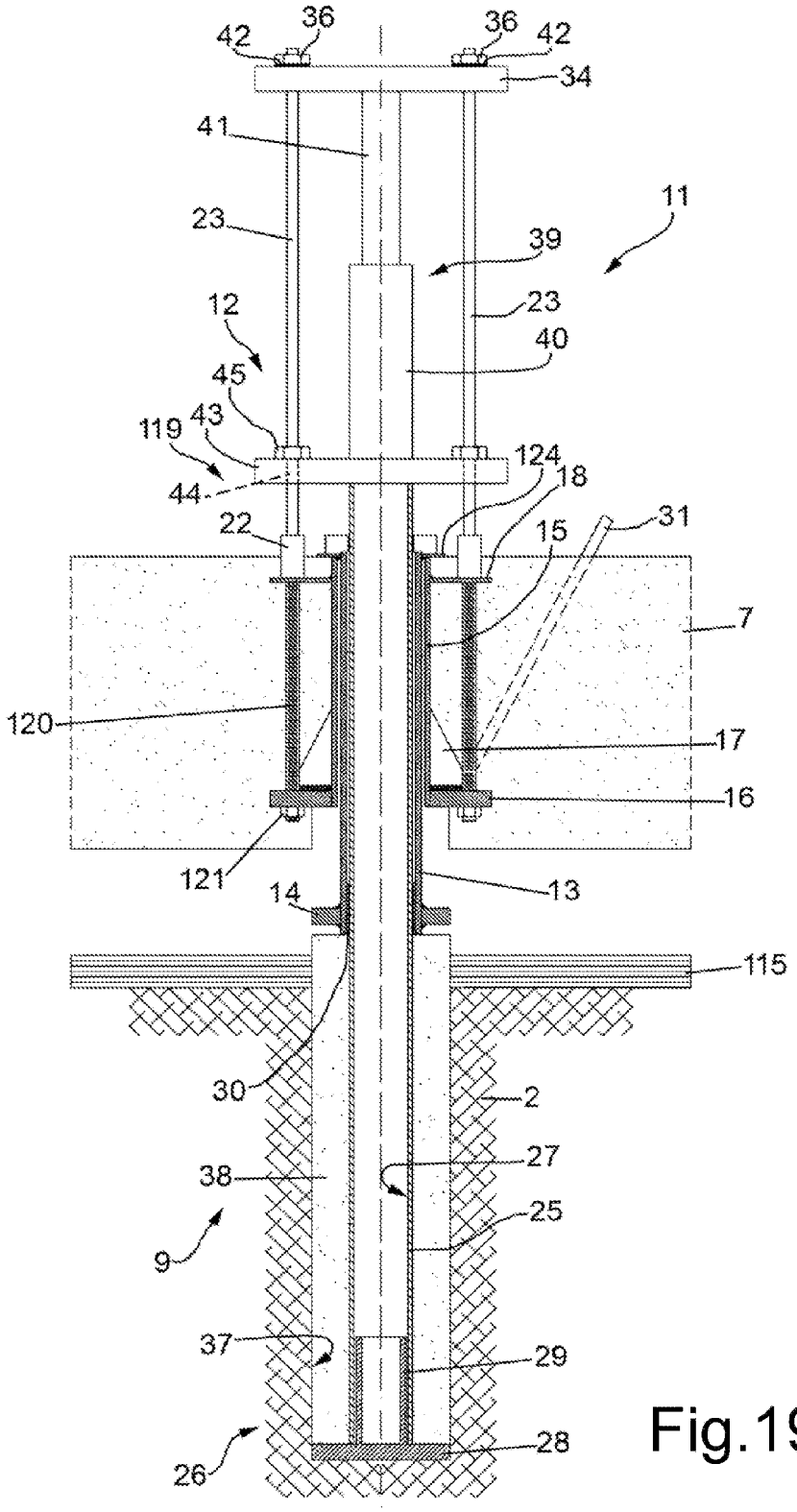
FIG. 19 shows a schematic lateral section of the FIG. 16 foundation pile connected to a lifting device.
Figure 20:
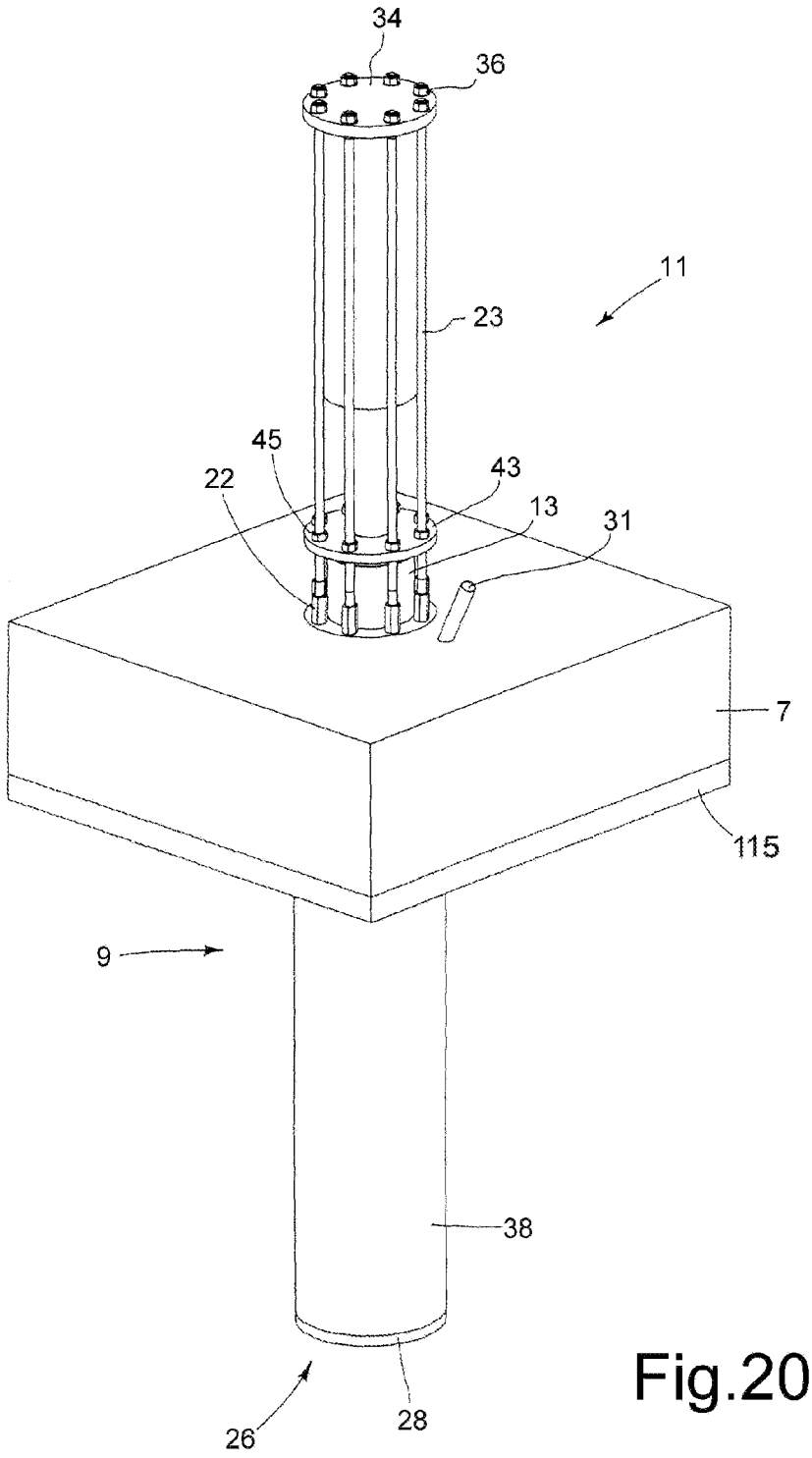
FIG. 20 shows a schematic view in perspective, with parts removed for clarity, of the FIG. 16 foundation pile connected to a lifting device.

As shown in FIGS. 19 and 20, once all the foundation piles 9 are driven, building 1 is raised.

To do this, each foundation pile 9 is fitted with a lifting device 11 resting on the top end of foundation pile 9 on one side, and connected to stays 23 on the other side. In actual use, each lifting device 11 is operated to produce, between foundation pile 9 and mat 7, static thrust which is transmitted to mat 7 by stays 23 acting as reaction members. It is important to note that, for each foundation pile 9, drive-in thrust is only applied to shaft 25 of foundation pile 9, whereas lift thrust is applied to both shaft 25 of foundation pile 9 and the corresponding guide tube 13, until guide tube 13 projects from the top of mat 7. When driving in foundation pile 9, this therefore slides axially with respect to guide tube 13, which remains stationary and integral with mat 7; whereas, when raising (or at least initially raising) the building, guide tube 13 slides axially with respect to slide tube 15, which remains stationary and integral with mat 7.

As shown in FIG. 19, each lifting device 11 comprises a hydraulic jack 139 in turn comprising a cylinder 40, from the top end of which extends a movable rod 41. Each hydraulic jack 139 is located between a bottom plate 43—which rests on the top end of foundation pile 9, is fitted through with stays 23, and has a number of through holes 44 to slide freely along stays 23 and top plate 34, which is fitted through with stays 23, and has a number of through holes 35 to slide freely along stays 23. Upward slide of top plate 34 is arrested by a number of nuts 36 screwed to stays 23 over top plate 34. At least one Belleville washer 42 is preferably interposed between each nut 36 and top plate 34, and, as it deforms elastically, allows top plate 34 to tilt slightly with respect to stays 23.

In actual use, each hydraulic jack 139 is operated to expand and so exert thrust, between foundation pile 9 and mat 7, which is transmitted to mat 7 by stays 23, which act as reaction members by maintaining a fixed distance between top plate 34 and mat 7 as hydraulic jack 139 expands.

In a preferred embodiment, stays 23 are fitted with safety nuts 45 located over and kept close to bottom plate 43 to limit downward travel of mat 7 in the event of a breakdown (hydraulic failure, resulting in loss of pressure, or mechanical failure) of hydraulic jack 139. Safety nuts 45 are preferably tightened using a torque wrench, so safety nuts 45 are all tightened equally and, when necessary, act symmetrically and in balanced manner.

Once all the lifting devices 11 are set up as described above, hydraulic jacks 139 can be operated to commence raising building 1. Depending on the height the building is to be raised, shaft 25 of each foundation pile 9 may be fitted with one or more additional tubular segments, which are gradually inserted through hole 12 as building 1 is raised with respect to ground 2, and are joined end to end as described previously. In other words, on reaching the end of a first segment of shaft 25, lifting device 11 is detached from the top end of the first segment to insert a second segment, which is butt welded to the first segment (possibly with a connecting piece in between); after which, lifting device 11 is connected to the top end of the second segment to continue the lift cycle.

The method, of controlling lifting device when raising building 1 is described in Patent Application WO2007138427A1 which is included herein by way of reference.

It is important to note that, when driving in each foundation pile 9, shaft 25 of foundation pile 9 slides with respect to guide tube 13, which remains stationary and integral with slide tube 15 and therefore with mat 7; whereas, when raising building 1, each slide tube 15 remains integral with mat 7, and guide tube 13 can slide axially with respect to slide tube 15 (and therefore with respect to mat 7) while remaining integral with foundation pile 9. More specifically, when lifting devices 11 apply the lift thrust to foundation piles 9, if a guide tube 13 is "stuck" to shaft 25 of foundation pile 9, the guide tube 13 remains integral with foundation pile 9 and slides axially with respect to slide tube 15 (and therefore with respect to mat 7); in which case, the thin bottom portion of mat 7 underneath anchoring flange 14 of tube 13 is fractured by guide tube 13 sliding axially with respect to slide tube 15 and mat 7.

Figure 21:
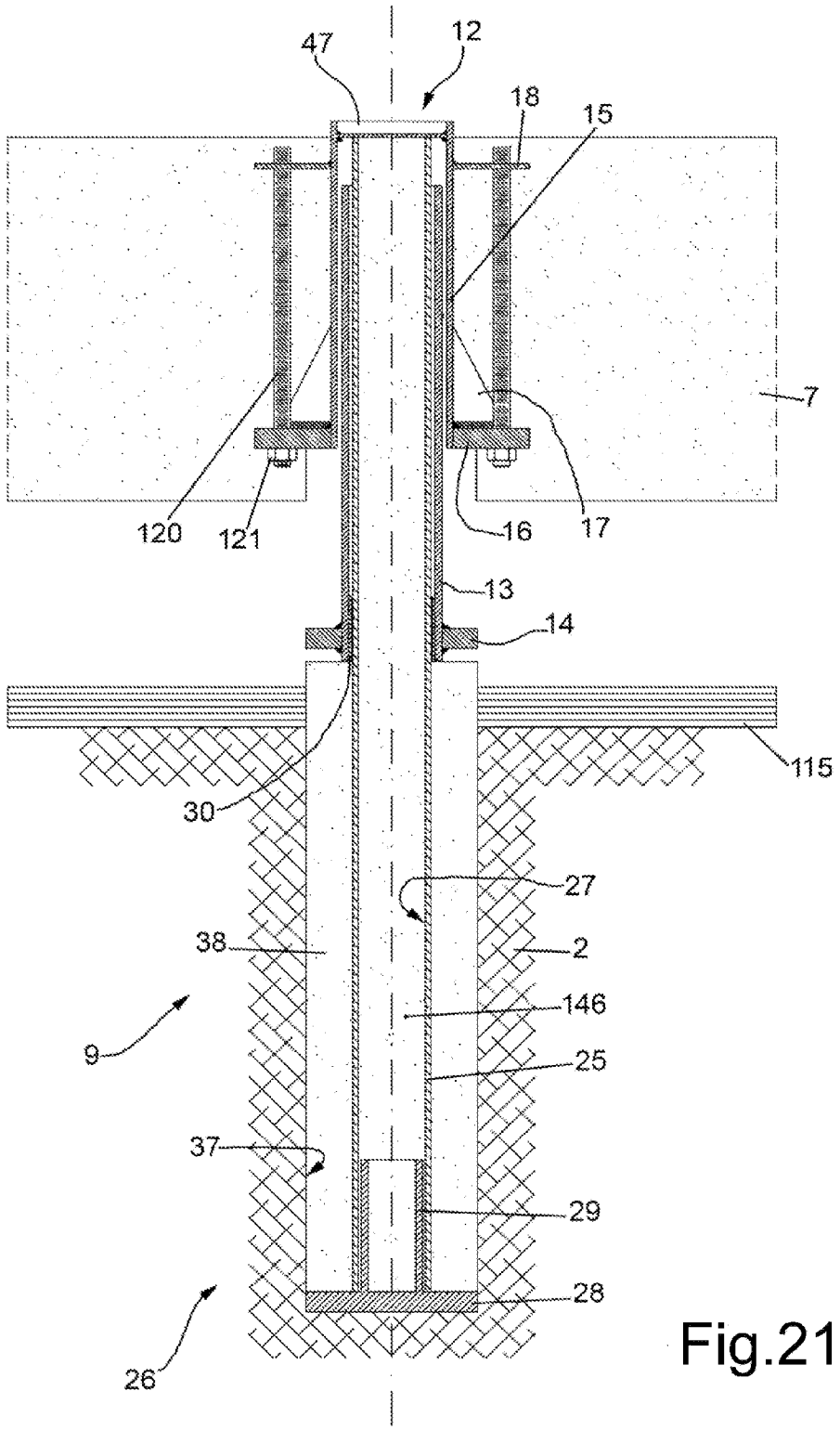
FIG. 21 shows a schematic lateral section of the FIG. 16 foundation pile at the end of the lifting operation.

As shown in FIG. 21, once lifting is completed, inner conduit 27 of each foundation pile 9 is filled with substantially plastic "concrete" 146. Once the inner conduit 27 of foundation pile 9 is filled, foundation pile 9 is fixed axially to mat 7 by securing (normally welding) to the top wall of slide tube 15 a circular or annular fastening plate 47 which is placed on top, to engage the top end, of foundation pile 9, so that the top end of foundation pile 9 rests against fastening plate 47 which is integral with slide tube 15. Alternatively, each foundation pile 9 may be filled with concrete 146 before commencing the lift, so that, when raising the building, each pile 9 is capable of supporting a greater load without yielding and/or deforming.

In a different embodiment not shown, a body of elastic material (e.g. neoprene) is interposed, inside slide tube 15, between the top end of foundation pile 9 and fastening plate 47, normally to enhance the antiseismic characteristics of mat 7.

Using a slide tube 15 about each guide tube 13, when driving in foundation pile 9, shaft 25 of foundation pile 9 slides with respect to guide tube 13, and the annular gap between the outer surface of guide tube 13 and the inner surface of slide tube 15 is sealed both at the top (by sealing ring 30 resting on the top wall of slide tube 15) and at the bottom (by anchoring flange 14 resting on the bottom wall of slide tube 15). During the lift (which normally takes place at least a month after the piles are driven, to allow adequate curing of concrete 38 of foundation piles 9), slide occurs, not between guide tube 13 and shaft 25 of each foundation pile 9, but between guide tube 13 and slide tube 15, thus preventing even severe sliding friction between shaft 25 of foundation pile 9 and guide tube 13 during the lift.

The invention claimed is:

1. A method of raising a building structure with respect to the ground comprising the steps of:

forming a mat having a plurality of through holes, each through hole is surrounded by a plurality of upwardly-projecting ties;

inserting through each of the plurality of through holes a respective foundation pile;

attaching to each foundation pile a respective lifting device, which on one side rests on the top end of the foundation pile and on the other side is secured to the upwardly-projecting ties of the foundation pile which act as reaction members;

exerting thrust on the foundation piles by the lifting devices to lift the building structure with respect to the ground;

fixing each foundation pile axially to the mat once lifting is completed;

dividing lifting of the building structure into a succession of lifting steps;

establishing a predetermined lifting value for each lifting step;

at each lift step, real-time measuring the actual lift of each lifting device;

at each lifting step, operating each lifting device to expand the lifting device by exactly the predetermined lifting value by feedback controlling each lifting device using the actual lift as a feedback variables; and wherein after driving in all the foundation piles and before raising the building structure with respect to the ground, further including the step of removing the ground and any existing foundation structures from underneath the mat, so that the mat and the entire building structure above the underside of the mat are supported solely by the foundation piles.

2. The method as claimed in claim 1, comprising the further steps of:

dividing the lifting devices into a plurality of work groups, each comprising at least one lifting device; and simultaneously operating the lifting devices of only one work group at a time, while the lifting devices of other work groups remain idle.

3. The method as claimed in claim 1, wherein each lifting device comprises at least one hydraulic jack; and the method comprises the further steps of:

sensing the hydraulic pressure of the corresponding at least one hydraulic jack as each lifting device is operated; and cutting off pressurized-fluid supply to the at least one hydraulic jack of the lifting device currently operating, if the sensed hydraulic pressure of the at least one hydraulic jack exceeds a predetermined maximum threshold value.

4. The method as claimed in claim 1, wherein each lifting device comprises at least one hydraulic jack; and as each lifting device is operated the method comprises the further steps of:

sensing the hydraulic pressure of the hydraulic jacks of the lifting devices currently idling and arranged close to the lifting device currently operating; and cutting off pressurized-fluid supply to the hydraulic jacks of the lifting devices currently operating, if the sensed hydraulic pressure of the hydraulic jacks of the lifting devices currently idling and arranged close to the lifting device currently operating falls below a predetermined minimum threshold value.

5. The method as claimed in claim 1, wherein each lifting device comprises at least one hydraulic jack located between a bottom plate, which rests on the top end of the foundation pile, is fitted through with the ties, and has a plurality of through holes to slide freely along the ties, and a top plate fitted through with the ties and having a plurality of through holes to slide freely along the ties; and wherein the method further comprises the step of arresting the upward sliding of the top plate by using a plurality of nuts screwed to the ties over the top plate.

6. The method as claimed in claim 5, wherein each lifting device includes safety nuts screwed to the ties, the safety nuts being located over the bottom plate and close to the bottom plate to limit downward travel of the mat.

7. The method as claimed in claim 5, wherein an elastic body in the form of a Belleville washer is interposed between each of the plurality of nuts and the top plate, so that as the elastic body deforms elastically the top plate is allowed to tilt slightly with respect to the ties.

8. The method as claimed in claim 1, further comprising the steps of:

lining each through hole with one guide tube;

inserting a foundation pile through each through hole and inside the corresponding guide tube;

applying at least one drive thrust to each foundation pile to drive in the foundation pile by sliding a shaft of the foundation pile with respect to the corresponding guide tube; and placing about the guide tube of each through hole a slide tube, which is coaxial with and surrounds the guide tube, and is axially slidable with respect to the guide tube to slide axially with respect to the guide tube and integrally with the mat when raising the mat.

9. A method of raising a building structure with respect to the ground comprising the steps of:

forming a new foundation structure that supports the building structure and has a plurality of through holes, each through hole being surrounded by a plurality of upward-projecting anchors;

lining each through hole with a guide tube;

inserting a foundation pile through each through hole and inside each guide tube;

applying at least one drive thrust to each foundation pile to drive in the foundation pile by sliding a shaft of the foundation pile with respect to each guide tube;

applying at least one lifting thrust to each foundation pile to raise the building structure with respect to the ground; and fixing each foundation pile axially to the new foundation structure once lifting is completed; and placing about each guide tube a slide tube which is coaxial with and surrounds the guide tube and is axially slidable with respect to the guide tube to slide axially with respect to the guide tube and integrally with the new foundation structure when raising the new foundation structure.

10. The method as claimed in claim 9, wherein for each foundation pile, drive thrust is applied solely to the shaft of the foundation pile, whereas lift thrust is applied to the shaft of the foundation pile and also to the corresponding guide tube, until the guide tube projects from the top of the new foundation structure.

11. The method as claimed in claim 9, comprising the further step of fitting each slide tube with an annular bottom anchoring flange, which is embedded in the new foundation structure and fixed centrally to an outer surface of the slide tube.

12. The method as claimed in claim 11, comprising the further step of fitting each bottom anchoring flange with a plurality of braces arranged radially and symmetrically about the slide tube and fixed both to the outer surface of the slide tube and to a top surface of the bottom anchoring flange.

13. The method as claimed in claim 11, comprising the further step of fastening the upward-projecting anchors of each through hole to the bottom anchoring flange of the slide tube.

14. The method as claimed in claim 11, comprising the further step of fitting each slide tube with an annular top locating flange embedded in the new foundation structure and fixed centrally to the outer surface of the slide tube.

15. The method as claimed in claim 14, comprising the further steps of:

fastening the upward-projecting anchors of each through hole to the bottom anchoring flange of the slide tube; and inserting the upward-projecting anchors of each through hole through the top locating flange of the slide tube.

16. The method as claimed in claim 11, comprising the further step of fitting each guide tube with an annular anchoring flange located beneath the slide tube, resting on a bottom wall of the slide tube, and fixed centrally to the outer surface of the guide tube.

17. The method as claimed in claim 9, comprising the further step of fitting each slide tube with a sealing ring located at the top of the slide tube and resting inside against an outer surface of the guide tube.

18. The method as claimed in claim 9, comprising the further step of fitting each guide tube with an annular anchoring flange located beneath the slide tube and fixed centrally to an outer surface of the slide tube.

19. The method as claimed in claim 18, comprising the further step of embedding the anchoring flange of each guide tube in a bottom portion of the new foundation structure, which is fractured when raising the building structure.

20. The method as claimed in claim 9, comprising the further step of fastening the upward-projecting anchors of each through hole to the slide tube.

21. The method as claimed in claim 9, comprising the further steps of positioning the guide tube so that a top portion of the guide tube projects upwardly from the new foundation structure; and positioning each slide tube flush with the new foundation structure.

* * * * *